US009924756B2

(12) United States Patent
Hyman

(10) Patent No.: US 9,924,756 B2
(45) Date of Patent: Mar. 27, 2018

(54) TOTAL CONTACT HELMET

(71) Applicant: Stephen Craig Hyman, West Bloomfield, MI (US)

(72) Inventor: Stephen Craig Hyman, West Bloomfield, MI (US)

( * ) Notice: Subject to any disclaimer, the term of this patent is extended or adjusted under 35 U.S.C. 154(b) by 0 days.

(21) Appl. No.: 15/192,268

(22) Filed: Jun. 24, 2016

(65) Prior Publication Data

US 2016/0286885 A1 Oct. 6, 2016

Related U.S. Application Data

(63) Continuation-in-part of application No. 14/564,367, filed on Dec. 9, 2014.

(Continued)

(51) Int. Cl.
*A42B 1/06* (2006.01)
*A42B 3/00* (2006.01)

(Continued)

(52) U.S. Cl.
CPC ..... *A42B 3/328* (2013.01); *A42B 3/06* (2013.01); *A42C 2/007* (2013.01); *A63B 71/10* (2013.01)

(58) Field of Classification Search
CPC ..... A42B 3/328; A42B 3/12; A42B 3/121; A42B 3/122; A42B 3/124; A42B 3/125;

(Continued)

(56) References Cited

U.S. PATENT DOCUMENTS 3,992,721 A 11/1976 Morton
4,754,501 A * 7/1988 Yahn ..... A42B 3/20 2/424

(Continued)

FOREIGN PATENT DOCUMENTS

GB 2202729 A * 10/1988 ..... A42B 3/063

OTHER PUBLICATIONS

MathiArasu et al., Computer Aided Ergonomic Design of Helmets Using Biomodelling, Computer-Aided Design and Applicaiions, Jan. 2004.

(Continued)

*Primary Examiner* — Jameson Collier
(74) *Attorney, Agent, or Firm* — Kohn & Associates, PLLC

(57) ABSTRACT

A total contact helmet, including a rigid body that is customized to an individual's head for being in direct contact with the head and having a force distribution mechanism for distributing the force of an impact laterally to a large surface area of the rigid body. A method of protecting the head of an individual by the individual wearing a total contact helmet including a rigid body that is customized to the individual's head for being in direct contact with the head and having a force distribution mechanism for distributing the force of an impact laterally to a large surface area of the rigid body, and when receiving an outside impacting force to the total contact helmet, distributing the force of impact over the surface area of the total contact helmet. A method of decreasing risk of concussion and head injury in an individual by wearing the total contact helmet.

4 Claims, 18 Drawing Sheets

Related U.S. Application Data

(60) Provisional application No. 61/913,586, filed on Dec. 9, 2013.

(51) Int. Cl.

| | |
|---|---|
| ***A63B 71/10*** | (2006.01) |
| ***A42B 3/32*** | (2006.01) |
| ***A42B 3/06*** | (2006.01) |
| ***A42C 2/00*** | (2006.01) |

(58) Field of Classification Search

CPC .. A42B 3/127; A42B 3/18; A42B 3/08; A42B 3/00; A42B 3/32; A42B 3/322; A42B 3/324; A42C 2/007; A63B 71/10

USPC ..... 2/410–415, 417, 418, 423, 424, 425

See application file for complete search history.

(56) References Cited

U.S. PATENT DOCUMENTS

| | | | | |
|---|---|---|---|---|
| 4,809,690 | A * | 3/1989 | Bouyssi | A42B 1/08 128/857 |
| 4,845,786 | A * | 7/1989 | Chiarella | A42B 3/065 2/412 |
| 4,903,346 | A | 2/1990 | Reddemann et al. | |
| 5,056,162 | A | 10/1991 | Tirums | |
| 5,094,229 | A * | 3/1992 | Pomatto | A61F 5/01 128/857 |
| 5,421,035 | A * | 6/1995 | Klose | A42B 3/066 2/411 |
| 5,687,426 | A * | 11/1997 | Sperber | A42B 3/061 2/411 |
| 5,891,372 | A | 4/1999 | Besset et al. | |
| 6,428,494 | B1 * | 8/2002 | Schwenn | A61F 5/05891 2/414 |
| 7,341,776 | B1 | 3/2008 | Milliren et al. | |
| 7,845,025 | B2 | 12/2010 | Tovo | |
| 7,930,771 | B2 | 4/2011 | Depreitere et al. | |
| 8,418,269 | B1 | 4/2013 | McBride | |
| 8,524,338 | B2 | 9/2013 | Anderson et al. | |
| 8,528,119 | B2 * | 9/2013 | Ferrara | A42B 3/063 2/455 |
| 8,533,869 | B1 * | 9/2013 | Capuano | A42B 3/124 2/171 |
| 8,613,114 | B1 * | 12/2013 | Olivares Velasco | A42B 3/125 2/171 |
| 2005/0050617 | A1 | 3/2005 | Moore, III et al. | |
| 2006/0101559 | A1 | 5/2006 | Moore, III et al. | |
| 2007/0130673 | A1 * | 6/2007 | Wasserkrug | A42B 1/08 2/411 |
| 2009/0031480 | A1 | 2/2009 | Torres | |
| 2011/0203038 | A1 | 8/2011 | Jones, Jr. | |
| 2012/0096631 | A1 | 4/2012 | King et al. | |
| 2012/0198604 | A1 | 8/2012 | Weber et al. | |
| 2012/0207964 | A1 * | 8/2012 | Faden | A41D 31/005 428/98 |
| 2013/0031700 | A1 * | 2/2013 | Wacter | A42B 3/322 2/411 |
| 2013/0061371 | A1 * | 3/2013 | Phipps | A42B 3/064 2/411 |
| 2013/0158949 | A1 * | 6/2013 | Ebisawa | A42B 3/127 702/157 |
| 2013/0305435 | A1 * | 11/2013 | Surabhi | A42B 3/067 2/414 |
| 2014/0013491 | A1 | 1/2014 | Hoshizaki et al. | |
| 2014/0013492 | A1 | 1/2014 | Bottlang et al. | |

OTHER PUBLICATIONS

MathiArasu et al., Computer Aided Ergonomic Design of Helmets Using Biomodelling, Computer-Aided Design and Applications, Jan. 2004.

* cited by examiner

TOTAL CONTACT HELMET

BACKGROUND OF THE INVENTION

1. Technical Field

The present invention relates to helmets and protective gear for protection of an individual's head and body in sports and other activities. More specifically, the present invention relates to customizable helmets, protective gear, and inserts for under helmets and protective gear.

2. Background Art

Helmets are designed to protect the head and brain and are used in a variety of activities and sports. Many helmets include a layer of crushable foam that crushes upon contact in order to control the crash energy and extend the stopping time of the head in order to reduce peak impact to the brain. The crushable foam is contained within a plastic skin. Often, as with bicycle helmets, once an impact has taken place, the foam does not recover to its original shape and must be replaced with a new helmet. Other types of helmets have a slow-rebound foam (butyl nitrate foam, or expanded polypropylene foam) that recover slowly after an impact and are reusable.

U.S. Pat. No. 8,528,119 to Ferrara discloses an impact-absorbing protective structure comprises one or more compressible cells that can be used in helmets. Each cell is in the form of a thin-walled plastic enclosure defining an inner, fluid-filled chamber with at least one small orifice through which fluid resistively flows. Each cell includes an initially resistive mechanism that resists collapse during an initial phase of an impact and that then yields to allow the remainder of the impact to be managed by the venting of fluid through the orifice. The initially resistive mechanism may be implemented by providing the cell with semi-vertical side walls of an appropriate thickness or by combining a resiliently collapsible ring with the cell. After the initially resistive mechanism yields to the impact, the remainder of the impact is managed by the fluid venting through the orifice. The cell properties can be readily engineered to optimize the impact-absorbing response of the cell to a wide range of impact energies. While the cells can be customized to a particular use of the helmet such as with materials of fabrication, size, geometry, etc., the helmet is not manufactured to be customized for a specific individual's head.

In physics, pressure equals force/area (P=F/A). If a person steps on a nail, it will puncture skin, whereas if a person lays on a bed of 1,000 nails, the skin is not punctured because the contact surface area is increased 1,000 fold and thus decreasing the pressure 1,000 fold. Even small changes in surface area have a dramatic decrease in pressure. For example, a sharp knife cuts through a steak very easily, whereas a dull knife requires a lot of effort to cut.

In medicine, the concept of total contact to decrease pressure of force of impact is well documented and studied. In an amputee, the weight of the body is transmitted through the bones. If one just put on an extension to weight bear the skin will break down over the area, or vectors of force, where bones transmit weight. Thus, total contact casting, created by casting with a reverse mold, and creating a total contact fit for a prosthesis is used to decrease pressure and markedly decrease any skin breakdown. Total contact casting is also used for ankle fracture immobilization, which all but eliminates heel decubitous ulcers by spreading out pressure over the area of total surface contact.

There remains a need for a helmet and other protective gear that can be customized to an individual's head and body and can more effectively reduce force of an impact.

SUMMARY OF THE INVENTION

The present invention provides for a total contact helmet including a rigid body that is customized to an individual's head for being in direct contact with said head and having a force distribution mechanism for distributing the force of an impact laterally to a large surface area of said rigid body.

The present invention provides for a method of protecting the head of an individual, by the individual wearing a total contact helmet including a rigid body that is customized to the individual's head for being in direct contact with the head and having a force distribution mechanism for distributing the force of an impact laterally to a large surface area of the rigid body, and when receiving an outside impacting force to the total contact helmet, distributing the force of impact over the surface area of the total contact helmet.

The present invention also provides for a method of decreasing risk of concussion and head injury in an individual by the individual wearing a total contact helmet including a rigid body that is customized to the individual's head for being in direct contact with the head and having a force distribution mechanism for distributing the force of an impact laterally to a large surface area of the rigid body, when receiving an outside impacting force to the total contact helmet, distributing the force of impact over the surface area of the total contact helmet, and decreasing the risk of concussion and head injury of the individual.

DESCRIPTION OF THE DRAWINGS

Other advantages of the present invention are readily appreciated as the same becomes better understood by reference to the following detailed description when considered in connection with the accompanying drawings wherein:

FIGS. 7A and 7B are graphs of concussion risk curves based on brain tissue response parameters wherein FIG. 7A shows brain maximum strain times and FIG. 7B shows brain maximum principal strain;

FIG. 15A shows a first piece and a second piece of the first contact helmet, FIG. 15B shows an inside view of a first piece, FIG. 15C shows a first piece with designed ventilation holes, and FIG. 15D shows a first piece.

DETAILED DESCRIPTION OF THE INVENTION

Figure 1:
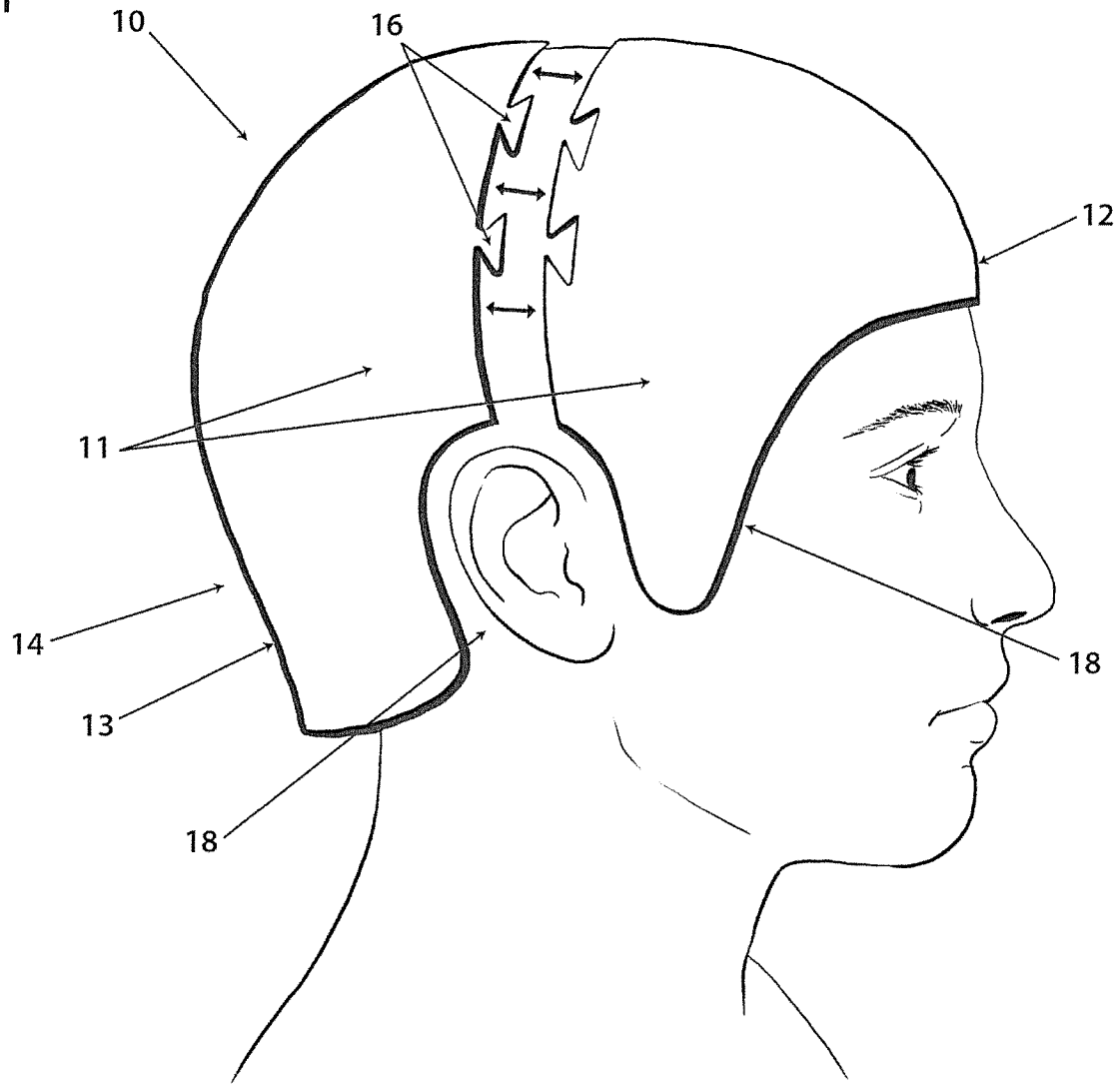
FIG. 1 is a side view of the total contact helmet.
Figure 2:
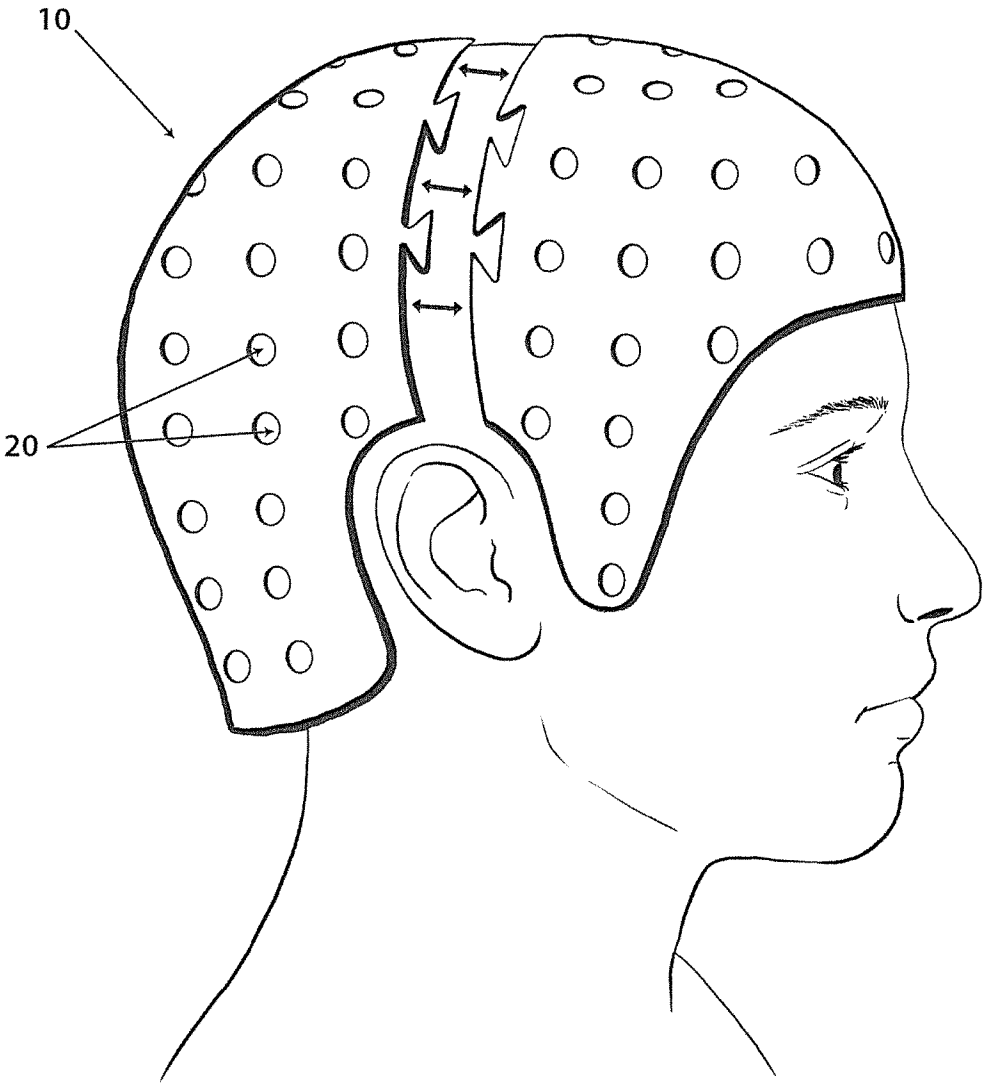
FIG. 2 is a side view of the total contact helmet with ventilation holes.
Figure 3:
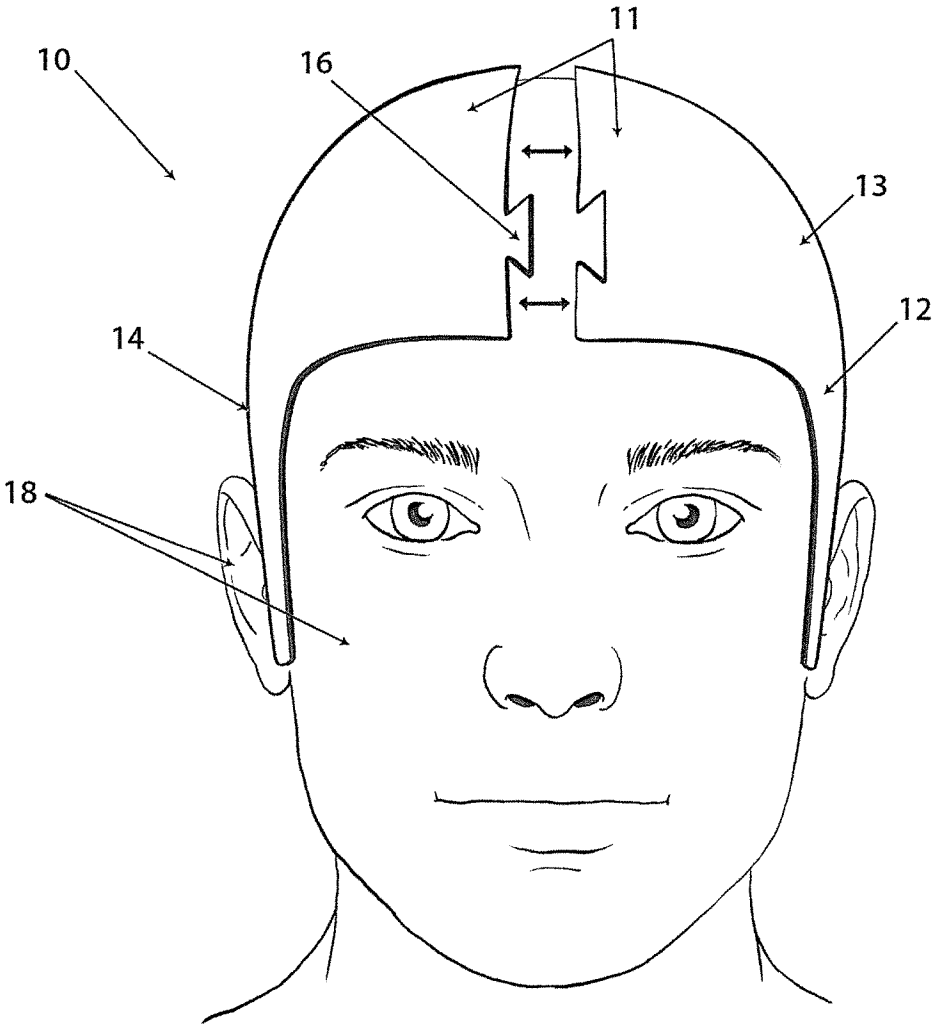
FIG. 3 is a front view of the total contact helmet.

The present invention generally provides for a total contact helmet 10 including a rigid body 11 that is customized to an individual's head and is able to distribute the force of an impact with a force distribution mechanism 13 to a large surface area of the helmet 10, as shown in FIGS. 1-3. The total contact helmet 10 laterally displaces force, rather than transmitting force to the skull and brain as in prior art designs and protects the head of an individual wearing the total contact helmet 10. The customization to the exact individual surface area underneath the total contact helmet 10 distributes or disperses the force of impact laterally to a larger surface area.

The total contact helmet 10 can be made of any suitable material that serves the function to spread an impact to a larger surface area and thus decrease pressure to the skull and brain of an individual. In other words, the force distribution mechanism 13 is preferably the material of the total contact helmet 10. The material can be, but is not limited to, hard plastic, and carbon fibers. It should be understood that the material of the rigid body 11 is hard and rigid and not compressible like a foam liner, as well as forming a perfect fit to an individual's head for direct contact with the head. The material can also be arranged in any suitable manner to spread the impact to a larger surface area. For example, the total contact helmet 10 can include honeycombed rectangle wafers such that a first wafer that receives an impact transmits force to two wafers in a second layer, and the two wafers transmit force to four wafers in the third layer, etc. This transmits the force of impact laterally and decreases pressure as the force is transmitted through multiple layers.

The total contact helmet 10 is designed and customized to fit an individual's head. There is preferably zero space between the surface of an individual's head and the total contact helmet 10 (i.e. the rigid body 11) when worn. The total contact helmet 10 can be in the form of a mask or a combination of a mask with a helmet or any other suitable design for a helmet. Preferably, the total contact helmet 10 covers every part of the individual's body that a conventional helmet would cover.

The total contact helmet 10 provides a total contact with the skull and face, and can be made circumferentially by a traditional cast and reverse mold or modern scan technology by 3D reconstruction or 3D printing technology. In other words, a cast can be made of the individual's head, or a 3D scan can be made of the individual's head to obtain the specific surface and contours of the individual's head. The total contact helmet 10 can then be printed with a 3D printer.

Figure 5:
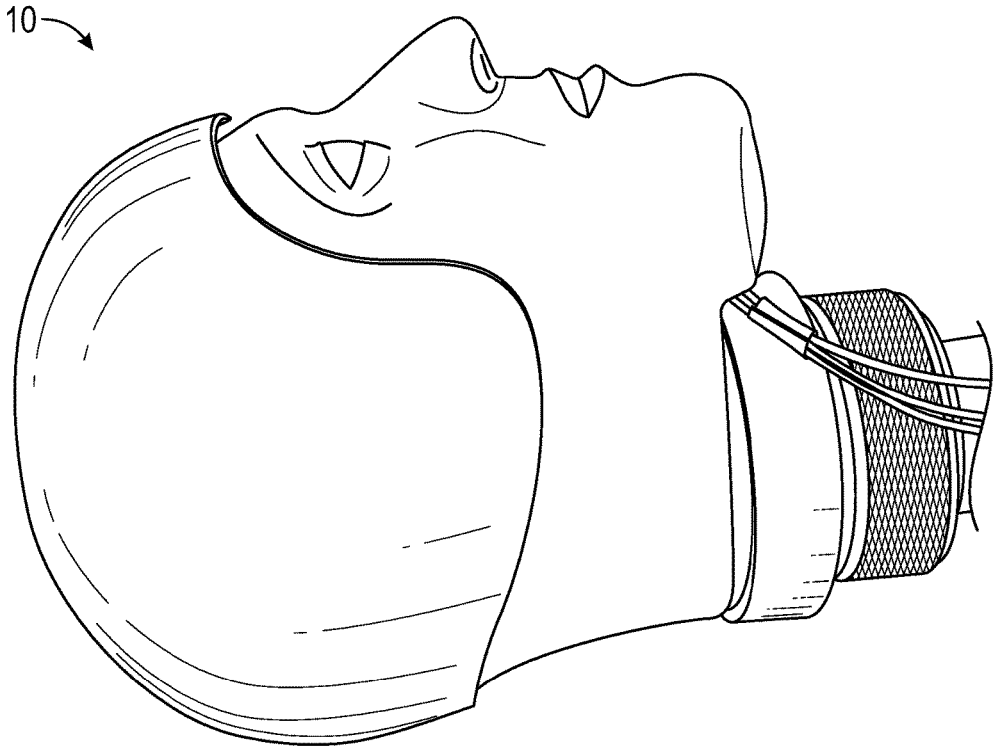
FIG. 5 is a photograph of a headform made by cast and reverse mold with the helmet of the present invention.
Figure 10:
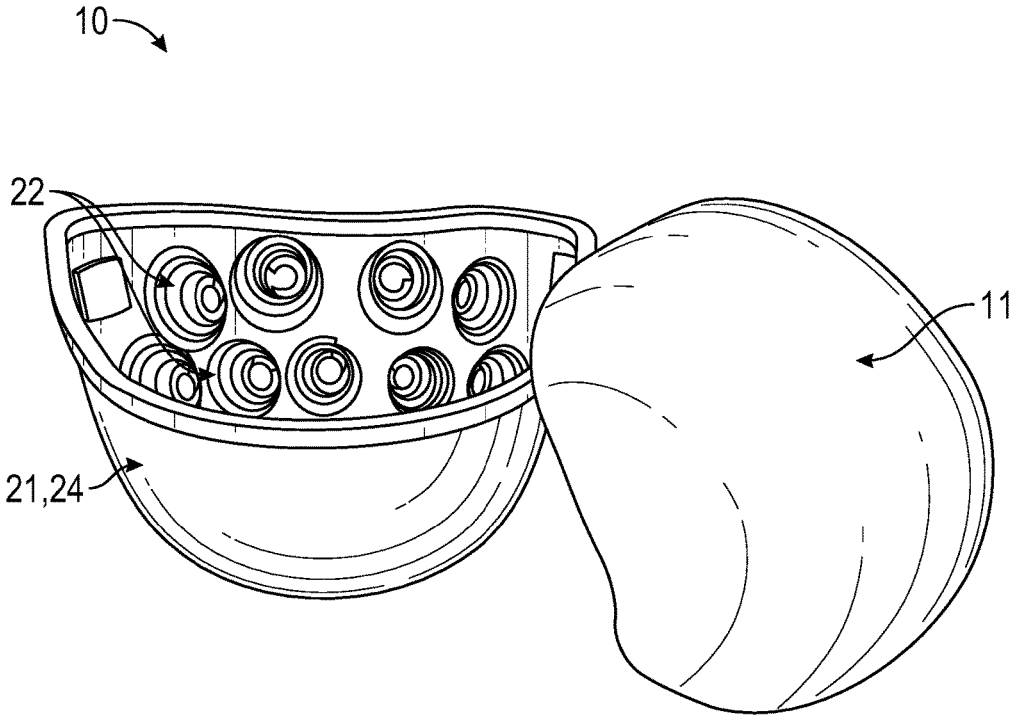
FIG. 10 is a photograph of a helmet, energy absorption mechanism, and body of the total contact helmet.

The total contact helmet 10 can be made as an insert ½ inch+/−½ inch that is at least two pieces (such as first piece 12 and second piece 14) held together by at least one interlock 16 or other technology to create total contact with significant surface area of the maximal exact surface area at least covering an entire area under the total contact helmet 10 or total contact protective equipment 100. First piece 12 can fit over the individual's face, and second piece 14 can fit over the individual's back part of the head as in FIG. 1, or alternatively, the first piece 12 can fit one side of the head and the second piece 14 can fit the opposite side of the head, as in FIGS. 15A-15D. Interlocks 16 can snap in place and can be pushed to close in order to connect the first piece 12 and second piece 14. The interlocks 16 can be unsnapped and the first piece 12 separated from the second piece 14 to remove the total contact helmet 10. Alternatively, the total contact helmet 10 can be made of a single piece, such as shown in FIG. 5 and FIG. 10.

Interlocks 16 allow maximal surface contact with the individual's head to provide circumferential force distribution that changes the force vector of impact in the side, front, and back of the total contact helmet 10 by dispersing or distributing force to a larger surface area of contact.

Cut outs 18 can be included for the general face area, mouth, nose, ears, chin, and neck, as well as other customizations such as for a cut out of a ponytail, etc.

Figure 15A:
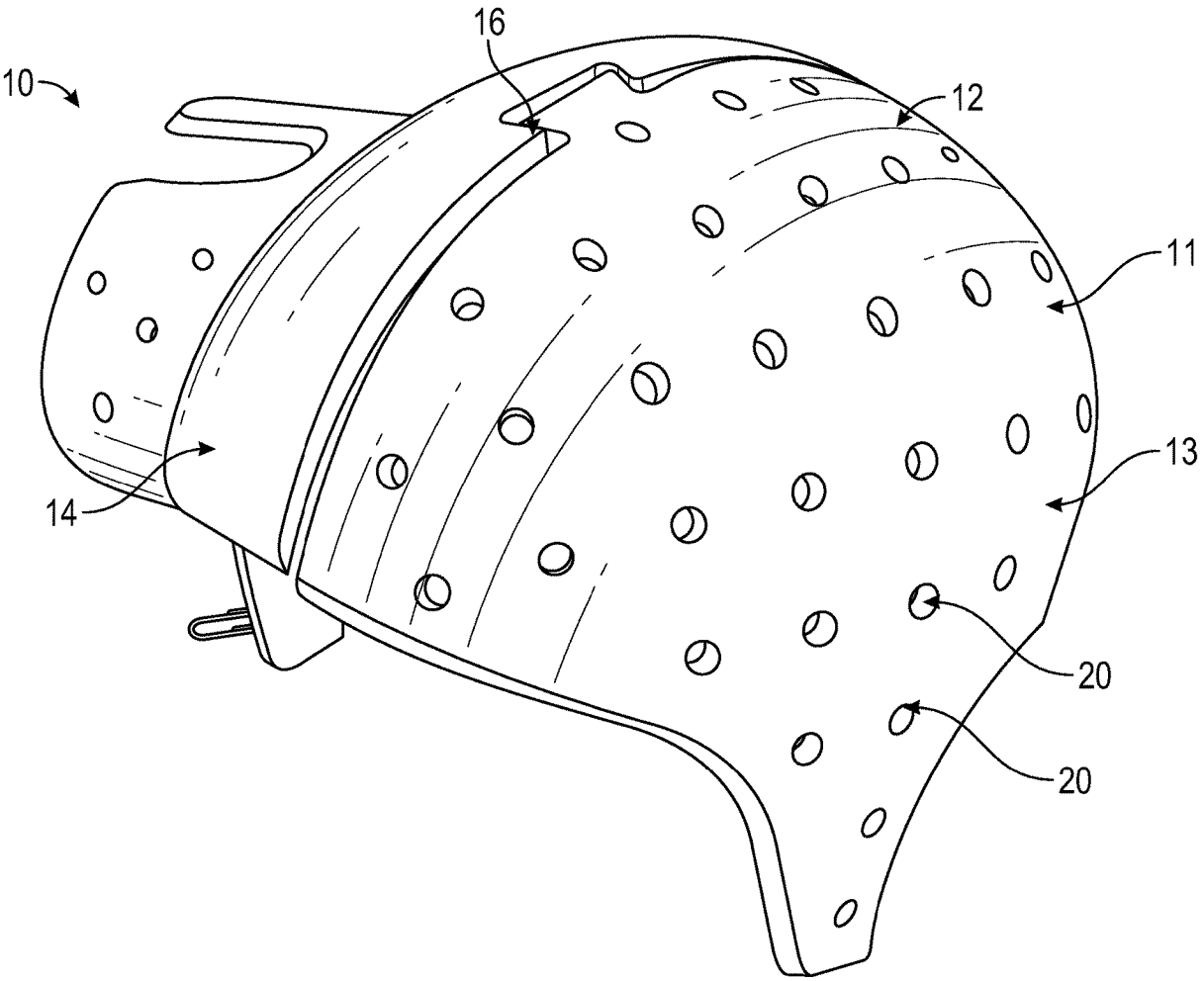
FIGS. 15A-15D are photographs of the first contact helmet made by scan, reverse engineering, and 3D print technology.
Figure 15B:
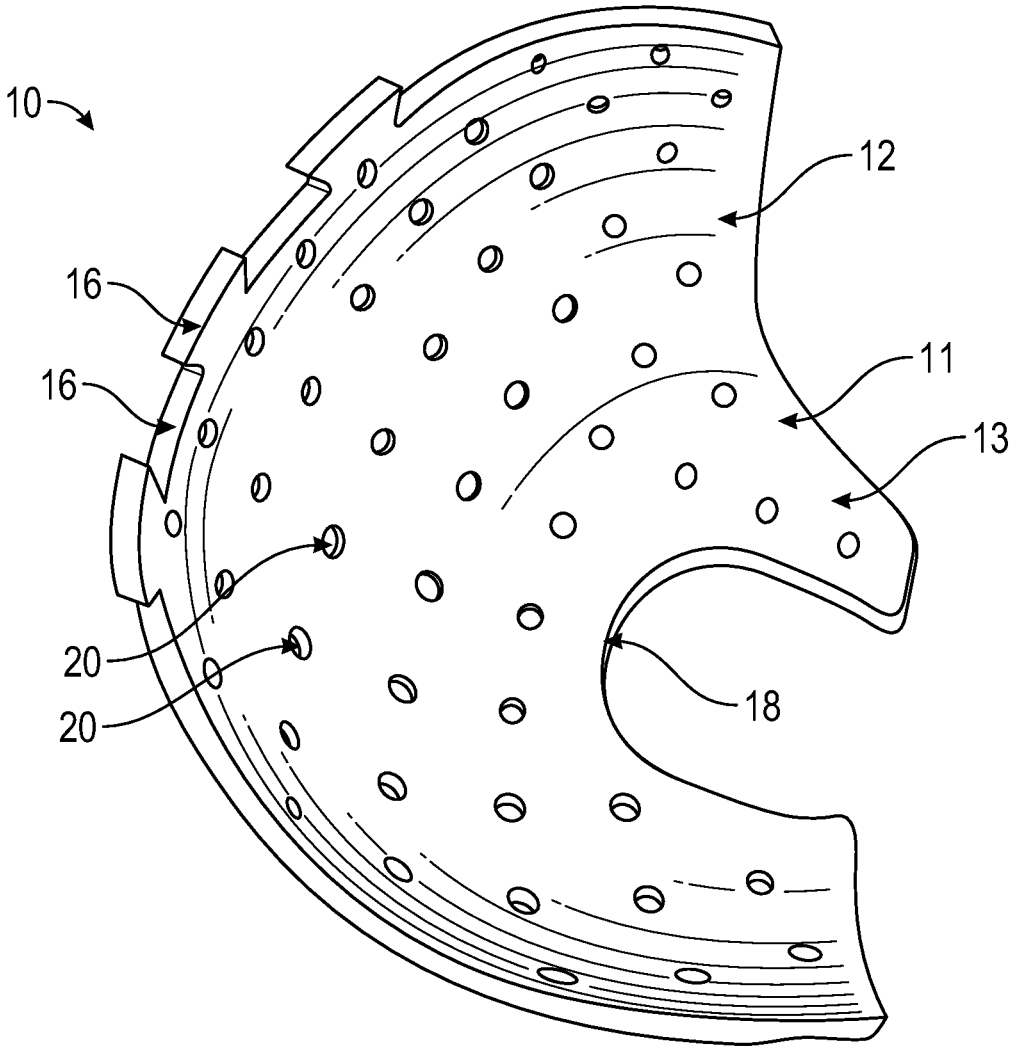
Figure 15C:
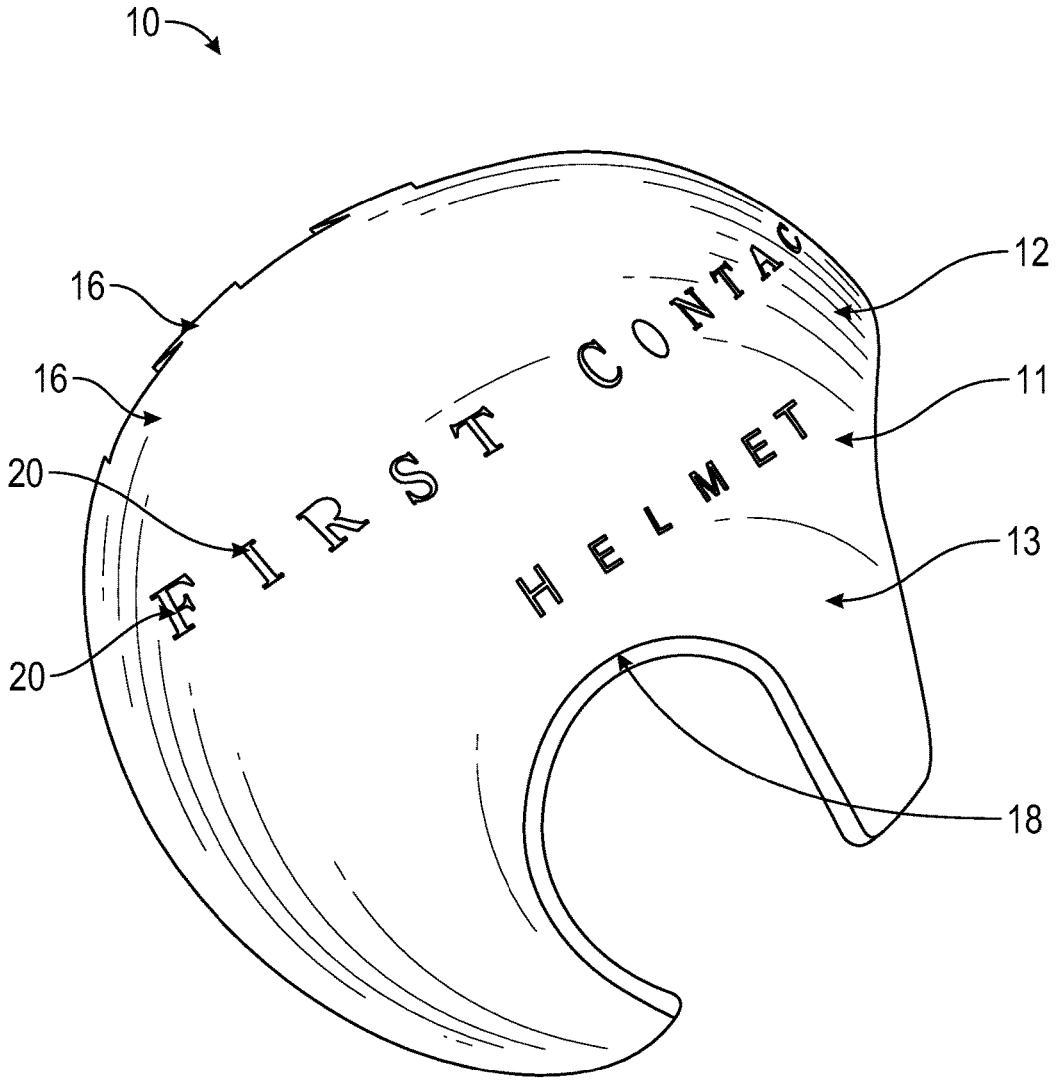
Figure 15D:
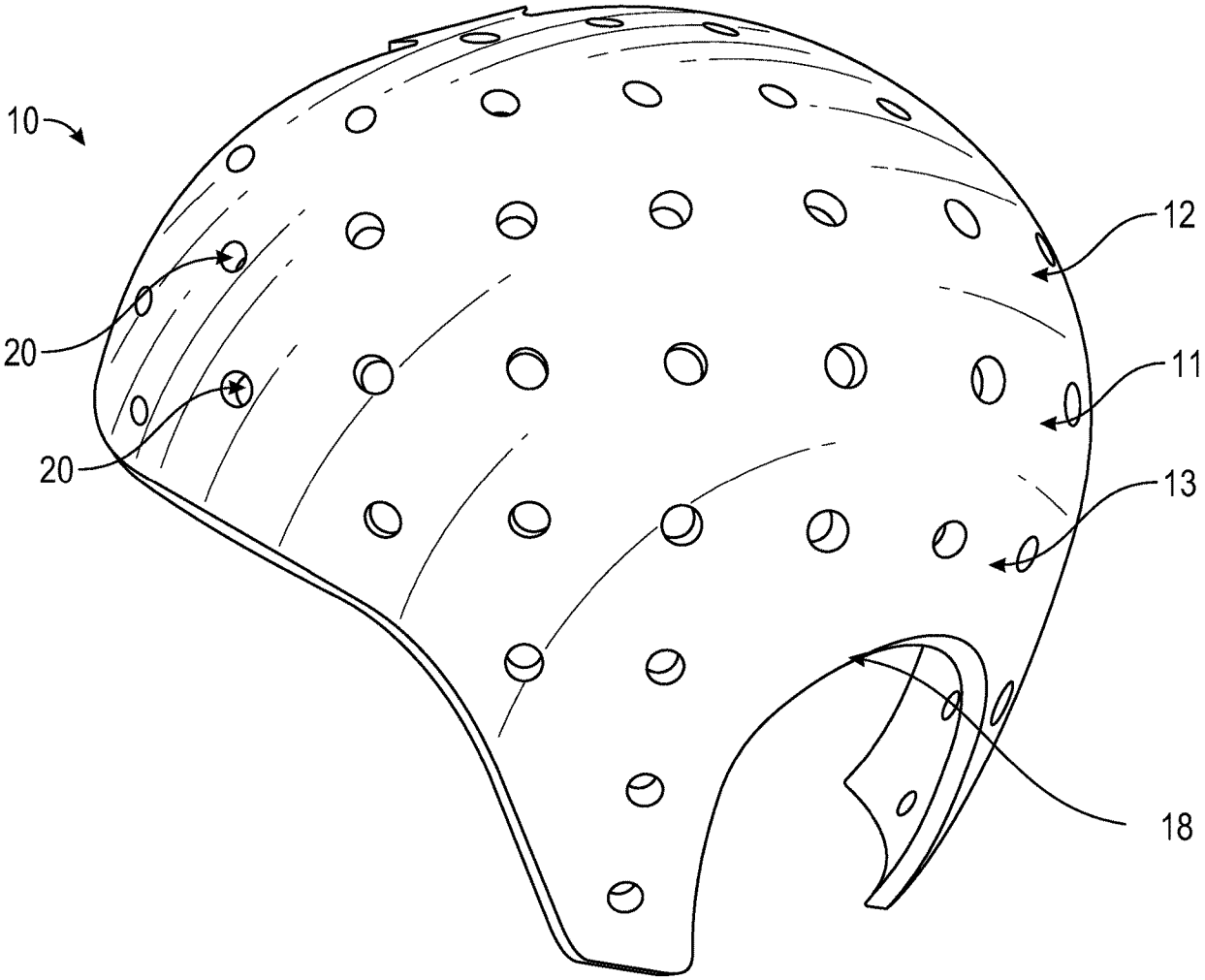

The total contact helmet 10 can include a ventilation mechanism 20 of ventilation holes or slits that can be anywhere suitable to provide adequate ventilation without decreasing surface area significantly to decrease impact reduction, as shown in FIG. 2. The shape of the ventilation mechanism 20 and color of the total contact helmet can be customized to meet needs of the manufacturer, i.e. a company logo (e.g. NIKE™'s swoosh) or team represented (i.e. block M's for THE UNIVERSITY OF MICHIGAN™ or S's for MICHIGAN STATE UNIVERSITY™ (MSU™, etc.). An example of the personalization of the ventilation mechanism 20 is shown in FIG. 15C (FIRST—First Impact Reducing Surface Total Contact Helmet—shown in letters). The total contact helmet 10 can be further personalized with colors that represent the team using the helmet or individual's preferences (i.e. green for MSU™ football players, red, white, and blue for USA Olympic downhill ski racers).

Figure 6:
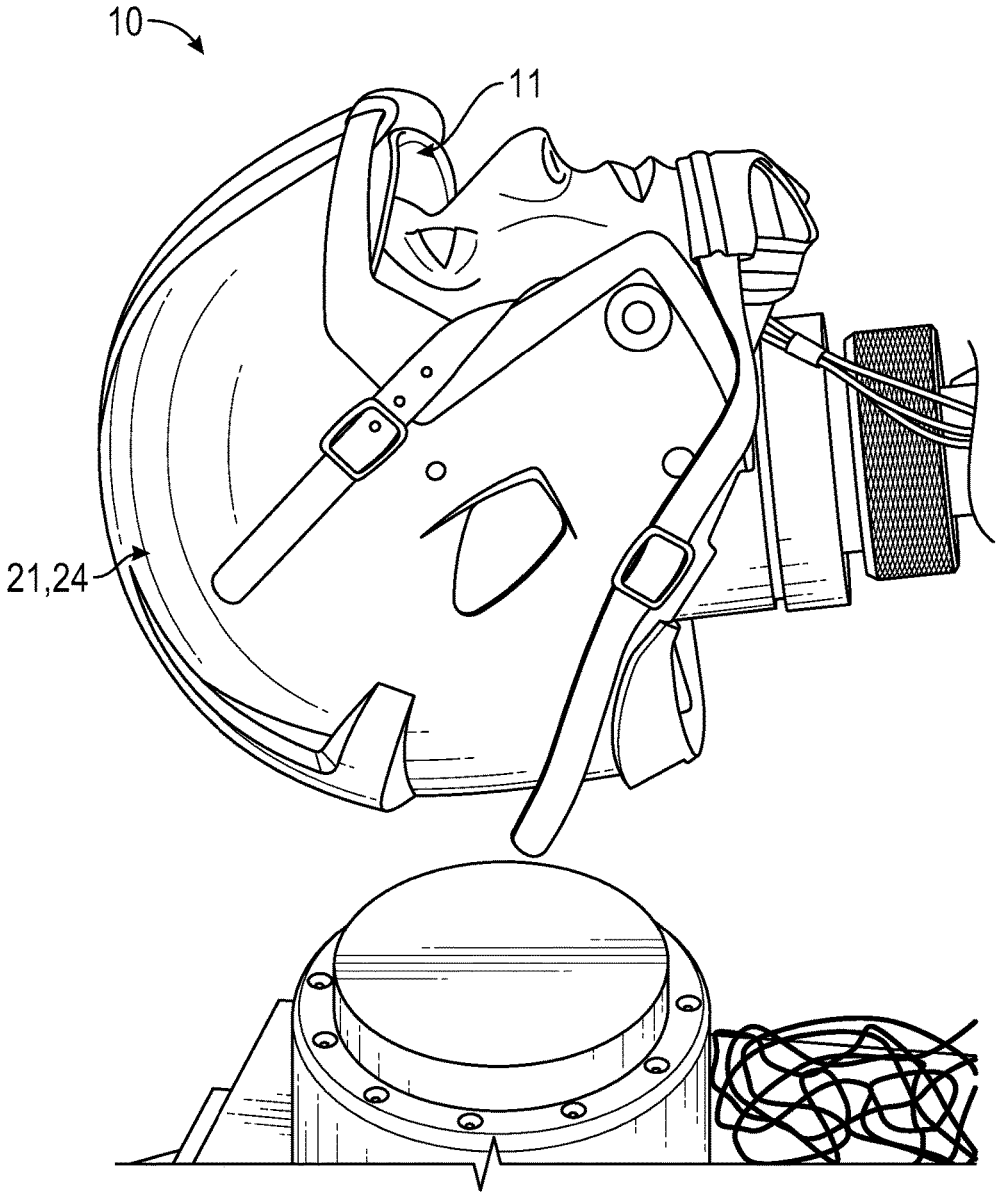
FIG. 6 is a photograph of a helmeted headform with or without the helmet of the present invention.

The total contact helmet 10 can be manufactured as an insert that fits into existing helmets 21 (it can be worn under an existing helmet 21, as shown in FIG. 6), or it can be directly manufactured as a stand-alone helmet and include a hard outside shell 24 made of plastics, thermoplastics, fiberglass, carbon composites, or any other suitable materials. The hard outside shell 24 can refer to a hard existing helmet 21.

Therefore, the present invention also provides for a total contact helmet insert, including a body that is customizable to an individual's head and having force distribution means for distributing the force of an impact to a large surface area of said body, the total contact helmet insert being insertable into an existing helmet. The total contact helmet insert can have any of the properties as described above.

Figure 8:
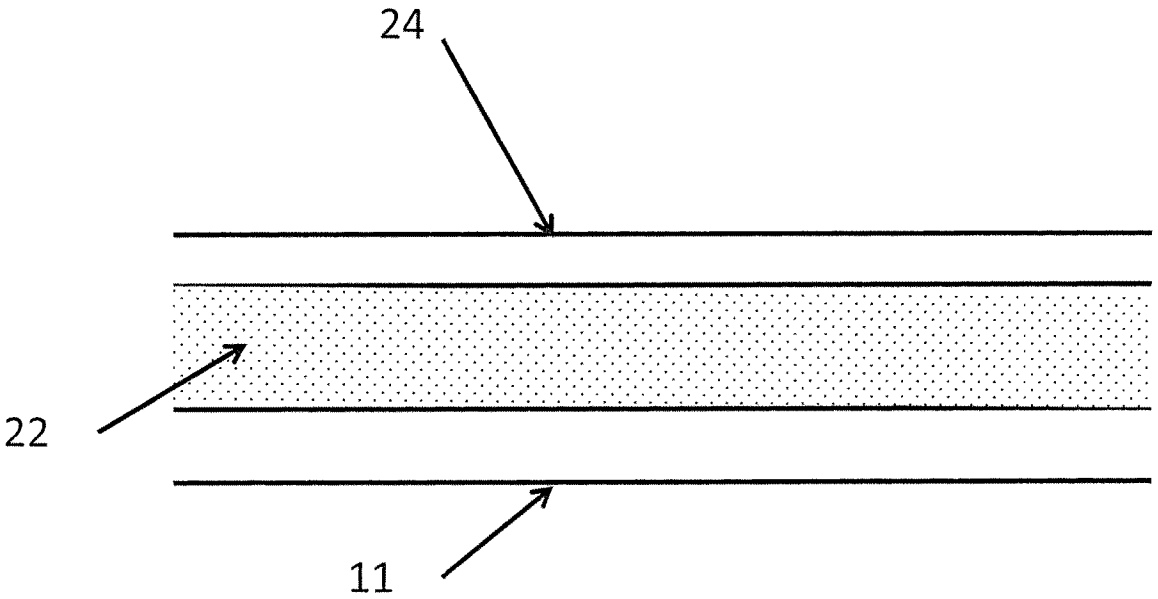
FIG. 8 is a cross-sectional view of the total contact helmet with an energy absorption mechanism.

The total contact helmet 10 can also include an energy absorption mechanism 22 that allows for increased energy absorption between the total contact helmet 10 and a hard outside shell 24 (wherein the hard outside shell 24 is either part of the total contact helmet 10 itself or a separate existing helmet 21 as described above), shown in FIG. 8 in cross-sectional view. The total contact helmet 10 of the present invention is additive to or synergistic to any technology that improves energy absorption or dissipation of impact force. In fact, the addition of a rigid customized inner liner (i.e. the total contact helmet 10) to a hard outside shell 24 creates opportunities for additional improvement for energy absorption as described as follows and gives all "cushioning" a greater surface area to distribute energy to. The energy absorption mechanism 22 can act as a cushion in between the hard outside shell 24/existing helmet 21 and the rigid body 11 of the total contact helmet 10. The energy absorption mechanism 22 can be disposed between the rigid body 11 of the total contact helmet 10 and the hard outside shell 24/existing helmet 21 at all contact points between the body and the hard outside shell 24/existing helmet 21. The energy absorption mechanism 22 can be, but is not limited to, fluids such as air or water, gels, matrices, springs, shock absorbing materials, magnetic forces from opposing magnets, or any other suitable mechanism. No shearing forces are present with the energy absorption mechanism 22. Example 3 describes the additional energy absorption present with the energy absorption mechanism 22.

The total contact helmet 10 can be used for many different sports or activities, such as, but not limited to, baseball (catchers, batters, other players), umpiring, hockey (goalies and other players), lacrosse, football, bicycling, motorcycling, boxing, wrestling, rugby, field hockey, skiing, snowboarding, skateboarding, military uses, construction uses, or any other sport or activity that involves contact with other individuals or objects.

The present invention provides for a method of protecting the head of an individual, by the individual wearing a total contact helmet including a rigid body that is customizable to the individual's head for being in direct contact with the head and having a force distribution mechanism for distributing the force of an impact laterally to a large surface area of the rigid body, and when receiving an outside impacting force to the total contact helmet, distributing the force of impact over the surface area of the total contact helmet. The design of the total contact helmet reduces and disperses the force over the entire portion of the body that the helmet 10/rigid body 12 covers (i.e. the skull, head, or face if in a mask form). The interlocking circumferential design changes the force vector of impact at the sides, front, and back of the helmet by decreasing focal pressure or pressure wave under the impact area by increasing surface area of contact. The method can further include increasing energy absorption between the total contact helmet and a hard outside shell and decreasing the impact of the outside impacting force on the brain by providing the energy absorption mechanism described above. The total contact helmet 10 used in this method can be any of those described above, with an existing helmet 21, with a hard outside shell 24, and/or with an energy absorption mechanism 22.

The present invention also provides for a method of decreasing risk of concussion and head injury in an individual by the individual wearing a total contact helmet including a rigid body that is customized to the individual's head for being in direct contact with the head and having a force distribution mechanism for distributing the force of an impact laterally to a large surface area of the rigid body, when receiving an outside impacting force to the total contact helmet, distributing the force of impact over the surface area of the total contact helmet, and decreasing the risk of concussion and head injury of the individual. As described in the Examples below, the use of the total contact helmet significantly decreases the risk of concussion and head injury by accepted risk prediction curves documented by state of the art independent clinical testing using finite element modeling.

The total contact helmet 10 works by spreading out the force of impact to decrease the focal injury behind the area of impact. Finite element modeling is computer-generated with 350,000 data points mapping the brain with a different density for bone, white matter, gray matter, fluids, etc. and calculates the surface impact acceleration in areas of injury in the brain. In simulation for impacts that cause concussions, hotspots are seen for areas of injury in areas of the brain that clinically correlate with loss of memory and disorientation, essentially what is seen in concussions. Current helmet testing does not use finite element modeling as they are not changing the total force so there is no decrease in concussion or injury. Standard helmet testing consists of dropping a helmet from 18 or 36 inches and only looks at surface acceleration and does not look inside the head. It is a very archaic and flawed system. The present invention shows that the total contact helmet 10 is able to protect the brain better than current helmets.

The total contact helmet 10 of the present invention provides several advantages. The outer shell of helmets can disperse impacts and prevent skull fractures, but the present invention can also protect the brain by decreasing risk of concussion and head injury. Not all injury is diffuse axonal injury, and as shown in the Examples below, the total contact helmet can disperse energy and decrease areas of strain and decrease the risk of concussion by 25% over RIDDELL™'s best NFL™ helmet. This is particularly advantageous with frontal impacts, which is of large concern with catcher's masks. Also, when used as an insert, the total contact helmet can provide a perfect custom fit that allows an increase of energy absorption between the insert and an outer shell (i.e. existing helmet). The total contact helmet 10 has been tested as shown in the Examples below using finite element modeling showing significant supporting evidence of the above advantages. The total contact helmet 10 was tested with a NFL™ helmet using National Standards for Athletic Equipment (NOCSAE) helmet certification testing and military advanced combat helmet (ACH) with drop testing in accordance with Federal Motor Safety Standards (FMVSS). The present invention showed significant decrease in brain strain and the product of brain strain rate as well as decreased intracranial pressure resulting in decreased concussion injury prediction probability under simulated impact conditions.

Figure 14:
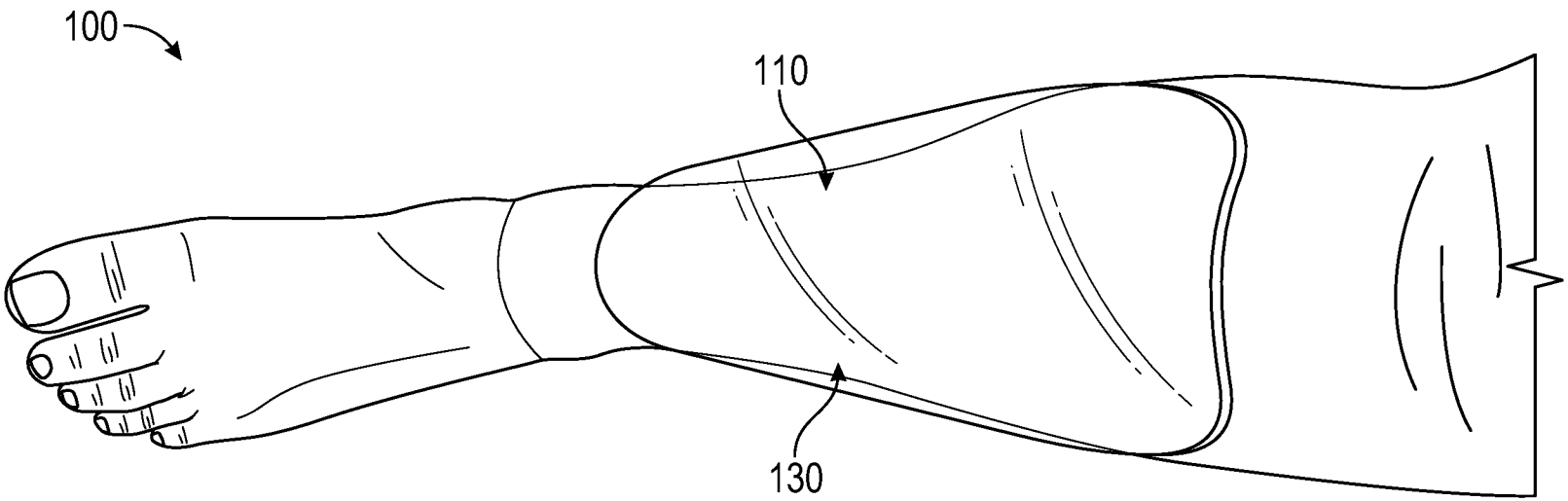
FIG. 14 is a photograph of a top view of a total contact protective equipment in the form of a shin guard.

The present invention also provides for other forms of total contact protective equipment 100, such as, but not limited to, shin guards (shown for example in FIG. 14), elbow guards, knee guards, and shoulder guards, in a form similar to the total contact helmet 10. The total contact protective equipment 100 includes a rigid body 110 that is customizable to an individual's body designed as described above and is able to distribute the force of an impact with a force distribution mechanism 130 to a large surface area of the total contact protective equipment 100. The total contact protective equipment 100 can include any of the properties as described above for the total contact helmet 10. The total contact protective equipment 100 can be attached in any suitable manner to the body with various attachments such as hook-and-loop straps, snaps, or buckles. The total contact protective equipment 100 can also act as an insert to fit inside or under existing protective equipment (i.e. an existing piece of equipment or a separate hard outside shell 24 as above) and be used with an energy absorption mechanism 22 as above. The total contact protective equipment 100 can further be directly integrated into sports apparel and sewn or otherwise kept in place (such as by insertion into pockets) in an appropriate area in the fabric or material to protect the body. For example, a shin guard can be integrated into a sock or leggings, shoulder guards can be integrated into a shirt, or elbow guards can be integrated into sleeves. The sports apparel can be, but is not limited to, a shirt, jersey, coat, jacket, pants, leggings, socks, underwear (jock strap, sports bra), sleeves, leg warmers, footwear, or gloves.

The invention is further described in detail by reference to the following experimental examples. These examples are provided for the purpose of illustration only, and are not intended to be limiting unless otherwise specified. Thus, the invention should in no way be construed as being limited to the following examples, but rather, should be construed to encompass any and all variations which become evident as a result of the teaching provided herein.

Example 1

Summary

The objective of the study was to evaluate the energy dissipation performance of the helmet First Impact Reducing Surface Total Contact (First Contact) design of the present invention when it was incorporated with the modern football helmet. It should be understood that reference to "First Contact" throughout the Examples herein refers to the total contact helmet 10 of the present invention. A combined series of standard helmet impact test, helmet-to-helmet impact test and computer modeling using a detailed human head model were conducted to quantify and assess the resulting global head responses and brain tissue responses to a range of helmet impact conditions. These biomechanical response parameters were compared between the helmeted head with and without use of the First Contact product. The risk of brain injury was assessed according to mild traumatic brain injury risk curves developed previously using NFL™ brain injury data.

Methods, Results, and Injury Prediction

1. NOCSAE Football Helmet Drop Test

Method

Figure 4:
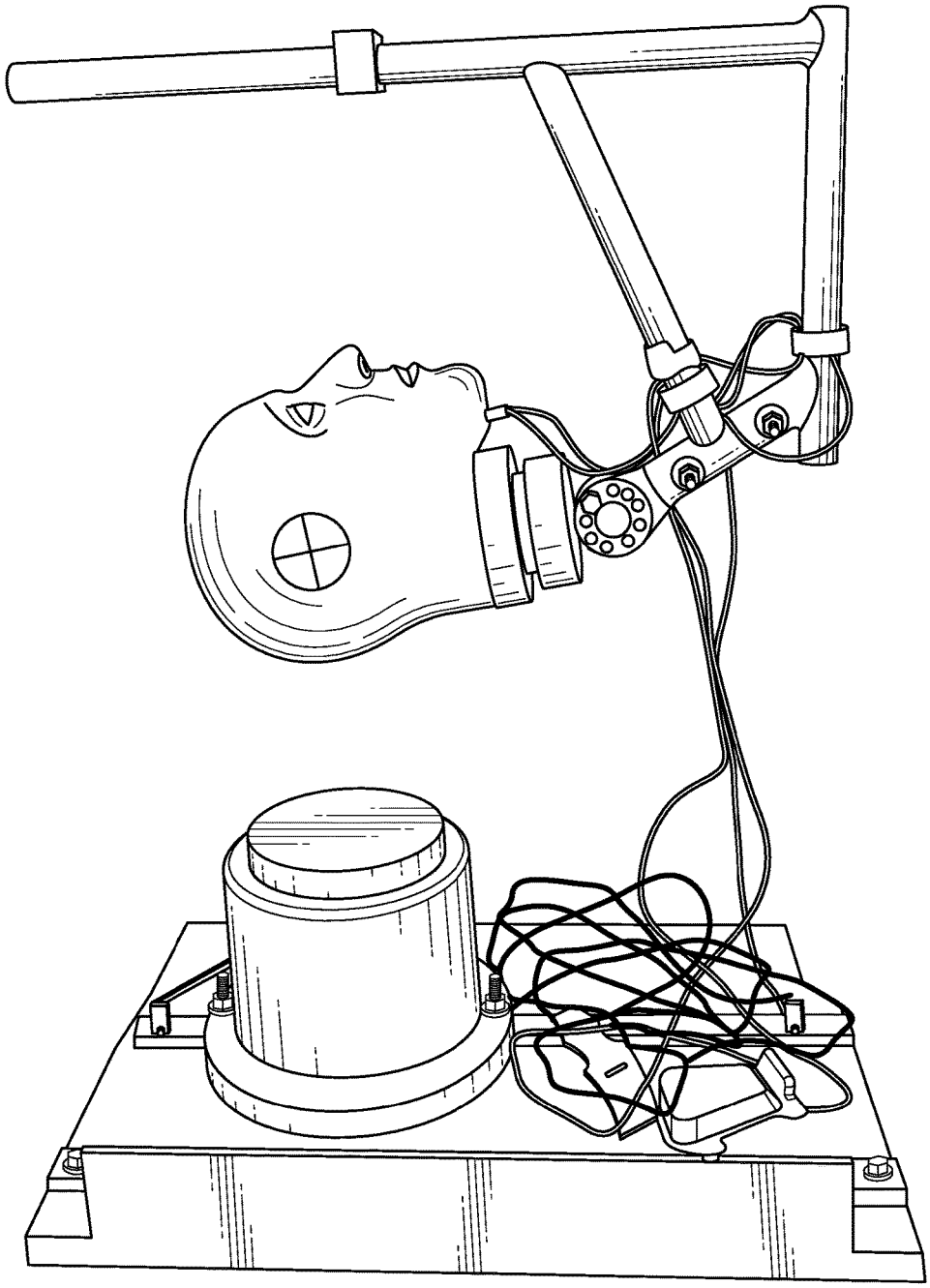
FIG. 4 is a photograph of a NOCSAE drop test setup in Example 1.

The National Operating Committee on Standards for Athletic Equipment (NOCSAE) football helmet certification test was carried out at Wayne State University. The helmeted headform was impacted from front, side, and rear locations onto a flat anvil from three impact heights (3 ft, 4 ft, 5 ft) (see TABLE 1, FIG. 4). The helmet used was a large size RIDDELL™ football helmet 2014 model (Riddell, IL) (FIG. 6). A medium size NOCSAE headform was used. The head acceleration in x-, y- and z-directions was measured by three accelerometers (Endevco Model 7264-2k, Meggitt, CA) mounted at the center of the gravity of the headform. The data was collected using DEWESOFT® SIRIUS® data acquisition system (Dewesoft, Slovenia) at sampling rate of 2,000 S/s. A First Contact product made of 2-3 mm thick graphite material (carbon fiber) was fitted on the NOCSAE mid-size headform (FIG. 5). At each impact height, the helmeted headform was tested first (test repeated twice) and followed by the helmeted-headform wearing the First Contact product (test repeated twice). A total of 54 tests were conducted for this series of study.

TABLE 1

Helmet Drop Test Matrix

| Helmet Impact Location | Drop Height (ft) | RIDDELL™ Helmet | RIDDELL™ Helmet with First Contact |
|---|---|---|---|
| Front | 3, 4, 5 | 3 tests at each height | 3 tests at each height |
| Side | 3, 4, 5 | 3 tests at each height | 3 tests at each height |
| Rear | 3, 4, 5 | 3 tests at each height | 3 tests at each height |

Results

The head accelerations measured in x, y, and z direction along with the resultant from each test are shown in TABLE 2. The percentage change of the average resultant head acceleration for each impact condition was calculated. The percentage change is defined as the relative change between the value from with First Contact product and the value from without First Contact product, and divided by the value from without the First Contact product. The highest reduction of head acceleration was in front impact condition followed by the rear impact at 3 and 4 ft. The reduction was small or adverse effect in case of side impact or 5 ft side and rear impact.

TABLE 2

Helmet Drop Test Results

| | W or w/o First Contact | Impact location | Drop height (ft) | Drop velocity (m/s) | Acc_x (g) | Acc_y (g) | Acc_z (g) | Acc_R (g) | Avg Change (%) |
|---|---|---|---|---|---|---|---|---|---|
| 1 | with | rear | 3 | 4.24 | 52.97 | 0.05 | 25.07 | 55.42 | −13% |
| 2 | | | | | 55.22 | 0.08 | 25.5 | 59.64 | |
| 3 | | | | | 59.71 | 0.10 | 25.44 | 63.33 | |
| 4 | | | 4 | 4.89 | 66.78 | 0.21 | 31.52 | 70.36 | −12% |
| 5 | | | | | 66.99 | 0.14 | 37.94 | 74.50 | |
| 6 | | | | | 71.11 | 0.08 | 29.67 | 75.12 | |
| 7 | | | 5 | 5.47 | 78.48 | 7.34 | 69.65 | 98.78 | 6% |
| 8 | | | | | 81.66 | 6.34 | 73.22 | 102.33 | |
| 9 | | | | | 78.08 | 6.79 | 67.35 | 100.69 | |
| 10 | without | rear | 3 | 4.24 | 48.99 | 0.48 | 51.48 | 68.07 | |
| 11 | | | | | 54.92 | 0.07 | 52.88 | 67.22 | |
| 12 | | | | | 59.24 | 0.11 | 52.17 | 70.76 | |
| 13 | | | 4 | 4.89 | 68.89 | 0.14 | 59.93 | 82.74 | |
| 14 | | | | | 64.18 | 0.08 | 61.70 | 84.33 | |
| 15 | | | | | 61.74 | 0.30 | 62.93 | 84.08 | |
| 16 | | | 5 | 5.47 | 73.67 | 13.19 | 69.09 | 92.70 | |
| 17 | | | | | 80.93 | 5.78 | 76.93 | 98.33 | |
| 18 | | | | | 80.72 | 5.05 | 75.73 | 94.08 | |

TABLE 2-continued

Helmet Drop Test Results

| | W or w/o First Contact | Impact location | Drop height (ft) | Drop velocity (m/s) | Acc_x (g) | Acc_y (g) | Acc_z (g) | Acc_R (g) | Avg Change (%) |
|---|---|---|---|---|---|---|---|---|---|
| 19 | with | side | 3 | 4.24 | 13.55 | 79.20 | 0.20 | 79.75 | −6% |
| 20 | | | | | 13.46 | 80.76 | 0.14 | 80.85 | |
| 21 | | | | | 11.08 | 77.50 | 0.19 | 78.22 | |
| 22 | | | 4 | 4.89 | 13.77 | 92.55 | 0.25 | 93.07 | −5% |
| 23 | | | | | 13.99 | 90.56 | 0.16 | 91.08 | |
| 24 | | | | | 13.10 | 94.38 | 0.11 | 94.60 | |
| 25 | | | 5 | 5.47 | 16.94 | 115.20 | 0.15 | 115.33 | 1% |
| 26 | | | | | 16.38 | 114.66 | 0.17 | 115.35 | |
| 27 | | | | | 15.46 | 108.73 | 0.27 | 109.83 | |
| 28 | without | side | 3 | 4.24 | 15.96 | 88.86 | 0.18 | 89.29 | |
| 29 | | | | | 11.65 | 78.11 | 0.17 | 78.40 | |
| 30 | | | | | 7.41 | 87.56 | 0.14 | 87.60 | |
| 31 | | | 4 | 4.89 | 8.56 | 97.91 | 0.23 | 97.92 | |
| 32 | | | | | 9.45 | 93.48 | 0.30 | 93.78 | |
| 33 | | | | | 11.56 | 100.30 | 0.19 | 100.35 | |
| 34 | | | 5 | 5.47 | 10.13 | 120.21 | 0.20 | 120.23 | |
| 35 | | | | | 13.07 | 108.84 | 0.15 | 109.30 | |
| 36 | | | | | 11.84 | 106.57 | 0.16 | 106.83 | |
| 37 | with | front | 3 | 4.24 | 72.86 | 0.00 | 0.13 | 72.86 | −10% |
| 38 | | | | | 74.03 | 0.00 | 0.17 | 74.03 | |
| 39 | | | | | 77.15 | 0.00 | 0.24 | 77.15 | |
| 40 | | | 4 | 4.89 | 108.33 | 0.00 | 0.24 | 108.33 | −16% |
| 41 | | | | | 111.50 | 0.00 | 0.19 | 111.50 | |
| 42 | | | | | 112.56 | 0.00 | 0.22 | 112.56 | |
| 43 | | | 5 | 5.47 | 149.27 | 0.00 | 0.32 | 149.27 | −16% |
| 44 | | | | | 152.21 | 0.00 | 0.38 | 152.21 | |
| 45 | without | front | 3 | 4.24 | 80.61 | 0.00 | 0.24 | 80.61 | |
| 46 | | | | | 83.39 | 0.00 | 0.22 | 83.39 | |
| 47 | | | | | 84.82 | 0.00 | 0.31 | 84.82 | |
| 48 | | | 4 | 4.89 | 130.77 | 0.00 | 0.42 | 130.77 | |
| 49 | | | | | 132.84 | 0.00 | 0.34 | 132.84 | |
| 50 | | | | | 133.83 | 0.00 | 0.22 | 133.83 | |
| 51 | | | 5 | 5.47 | 181.34 | 0.00 | 0.28 | 181.34 | |
| 52 | | | | | 177.34 | 0.00 | 0.35 | 177.34 | |
| 53 | | | | | 180.86 | 0.00 | 0.39 | 180.86 | |

Note:

Acc_x, Acc_y, Acc_z, and Acc_R are accelerations in x, y, z directions and the resultant.

2. Computer Modeling of Brain Responses

The magnitude, direction and profile of the head motion can affect the tissue strain patterns, region of the injury in the brain owing to asymmetric anatomy and regional heterogeneous properties of the human head/brain. A detailed, validated computer model of human head based on finite element (FE) technique (Zhang, et al., 2001) was applied to simulate helmet drop tests and helmet-to-helmet impactor tests. The differences in brain responses predicted by the model between the head with and without use of First Contact product were compared and results were to assessed for concussion risk at a given impact condition.

2.1 Simulate Helmet-to-Helmet Linear Impactor Test Method

The helmet-to-helmet frontal linear impactor tests previously conducted by the WSU group with and without the First Contact were simulated using the head model. A total of four sets of 3D translational acceleration and rotational velocity time histories measured from the Hybrid III head with and without the First Contact product was applied to the head model to simulate the impact tests. Various biomechanical responses in the brain including maximum principal strain, maximum strain rate, maximum product of strain times strain rate, and peak brain pressure were calculated, analyzed, and compared between the conditions with and without using First Contact product.

Results

TABLE 3 summarizes the model predicted maximum principal strain, maximum product of strain and strain rate, and peak coup pressure in the brain. These tissue level parameters were previously proposed as relevant concussion injury predictors based on simulations of 58 NFL™ football impact cases using the current head model (Zhang, et al., 2004, Viano, et al., 2005, King, et al., 2003). TABLE 2 demonstrates the effect of First Contact product on the resulting brain strain, product of strain and strain rate, brain pressure values from simulations of two helmet-to-helmet linear impactor tests in frontal direction. A reduction of between 6-13% for brain strain and 10-21% for product of brain strain times strain rate was noted due to the use of First Contact product.

TABLE 3

| Biomechanical Response Parameters in the Brian Predicted by the Head Model | | | | | | |
|---|---|---|---|---|---|---|
| | Concussion Injury Predictor | | | | | |
| | w_test1 | w_test5 | w/o_test1 | w/o_test5 | Percentage Change_test1 | Percentage Change_test5 |
| Max principal strain x strain rate (s−1) | 23 | 27 | 30 | 31 | −21% | −10% |
| Maximum principal strain | 0.50 | 0.53 | 0.57 | 0.58 | −13% | −6% |
| Coup Pressure (kPa) | 71.8 | 55.8 | 69.9 | 61.5 | 3% | −9% |

Injury Prediction

Figure 7B:
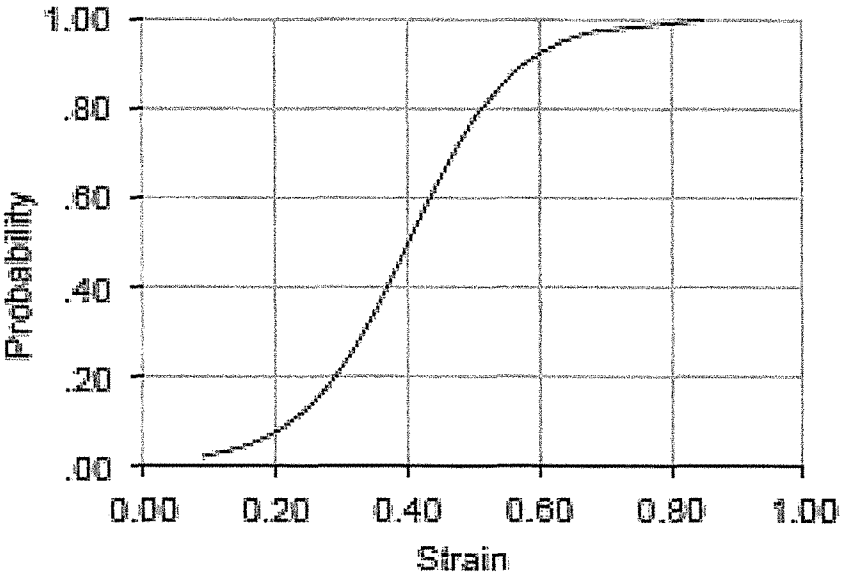
Figure 7A:
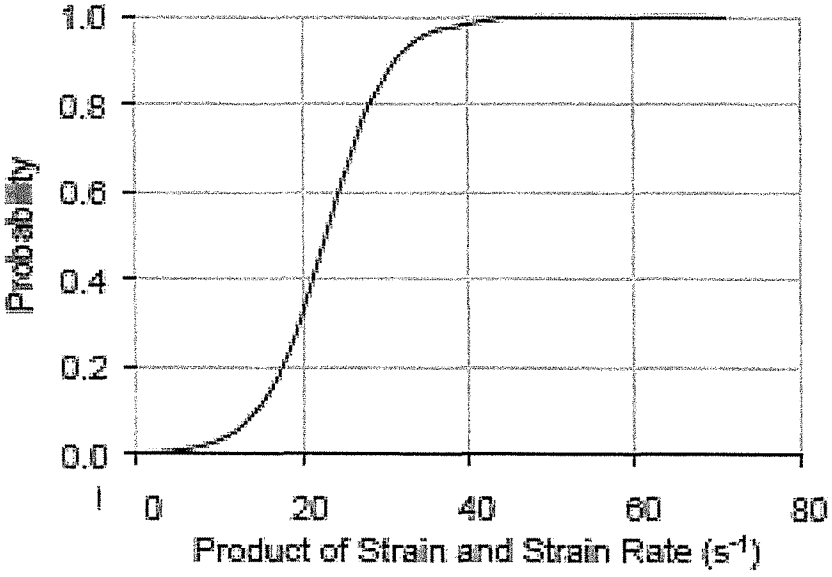

A concussion injury risk curve is presented in FIG. 7A where a 25% probability of injury was predicted with the product of strain times strain rate being 18 $s^{-1}$. Values for the product of strain times strain rate at both 50% and 90% were predicted at 23 $s^{-1}$ and 34 $s^{-1}$, respectively. In the current study, using the product of brain strain and brain strain rate as a predictor for concussion, the helmet only impact had >80% probability of injury with the First Contact product having <60% probability of injury under the simulated impact condition.

A concussion injury risk curve derived from NFL™ concussion studies is presented in FIG. 7B where a 25% probability of injury is predicted with 0.30 strain. Values for strain at both 50% and 90% were predicted at 0.40 and 0.58, respectively. For the current study, based on averaged brain strain response, the model predicted >80% probability of injury with the helmet only in comparison to the model with the use of an additional First Contact product where <65% probability of injury was predicted.

2.2 Simulate Helmet Drop Test

Method

The measured head acceleration data from helmet drop tests were applied to the head model to compute the brain pressure within the brain. A total of 12 representative cases were selected and simulated as shown TABLE 4.

TABLE 4

| Simulation matrix | | | |
|---|---|---|---|
| Impact Location | Drop Height (ft) | RIDDELL™ Helmet Only | RIDDELL™ Helmet with First Contact |
| Front, side, rear | 4, 5 | Total 6 cases simulated | Total 6 cases simulated |

Results

TABLES 5-7 summarize the peak values of intracranial pressure and pressure rate predicted by the head model for frontal, side and rear drop tests. The percentage reduction of the response values due to the use of the First Contact product was also calculated. The reduction of brain pressure was significant in frontal impact cases (5 and 4 ft drop heights). There was, however, no or little effect due to the use of the First Contact product in case of side and rear impact. Note that the reduction of brain pressure rate response was more profound as compared to that of brain pressure response for all impact conditions. In addition, pressure rate reduction was higher in 4 ft drop group than in 5 ft drop group for all impact directions.

TABLE 5

| Summary of model prediction from frontal drop test | | | |
|---|---|---|---|
| Pressure Response | Model Case | Peak Values | Difference: w vs w/o |
| Pressure (kPa) | front_w_4 ft | 105 | −17% |
| | front_w_5 ft | 140 | −17% |
| | front_wo_4 ft | 126 | |
| | front_wo_5 ft | 169 | |
| Pressure rate (kPa/ms) | front_w_4 ft | 45 | −46% |
| | front_w_5 ft | 58 | −39% |
| | front_wo_4 ft | 83 | |
| | front_wo_5 ft | 96 | |

TABLE 6

| Summary of model prediction from side drop test | | | |
|---|---|---|---|
| Pressure Response | Model Case | Peak Values | Difference: w vs w/o |
| Pressure (kPa) | side_w_4 ft | 70.4 | −1% |
| | side_w_5 ft | 85.6 | −3% |
| | side_wo_4 ft | 70.9 | |
| | side_wo_5 ft | 88.7 | |
| Pressure rate (kPa/ms) | side_w_4 ft | 17.9 | −19% |
| | side_w_5 ft | 21.0 | −13% |
| | side_wo_4 ft | 22.2 | |
| | side_wo_5 ft | 24.0 | |

TABLE 7

| Summary of model prediction from rear drop test | | | |
|---|---|---|---|
| Pressure Response | Model Case | Peak Values | Difference: w vs w/o |
| Pressure (kPa) | rear_w_4 ft | 49 | 0% |
| | rear_w_5 ft | 89 | −3% |
| | rear_wo_4 ft | 49 | |
| | rear_wo_5 ft | 86 | |
| Pressure rate (kPa/ms) | rear_w_4 ft | 24 | −9% |
| | rear_w_5 ft | 40 | −21% |
| | rear_wo_4 ft | 31 | |
| | rear_wo_5 ft | 44 | |

Example 2

The objective of the study was to evaluate the energy dissipation performance of the helmet First Impact Reducing Surface Total Contact (First Contact) design of the present invention when it was incorporated with the modern Advance Combat Helmet (ACH) currently used by the U.S. Army. A series of helmet blunt impact tests were conducted according to the test methodology reported by McEntire and Whitley (2005) at U.S. Army Aeromedical Research Laboratory. The helmet with and without First Contact was tested at two impact velocities, four impact sites with three successive impacts. The performance was quantified by the resultant acceleration measured at the center of the gravity of the headform and compared between the helmeted-head with and without use of the First Contact product.

Methods

Figure 9:
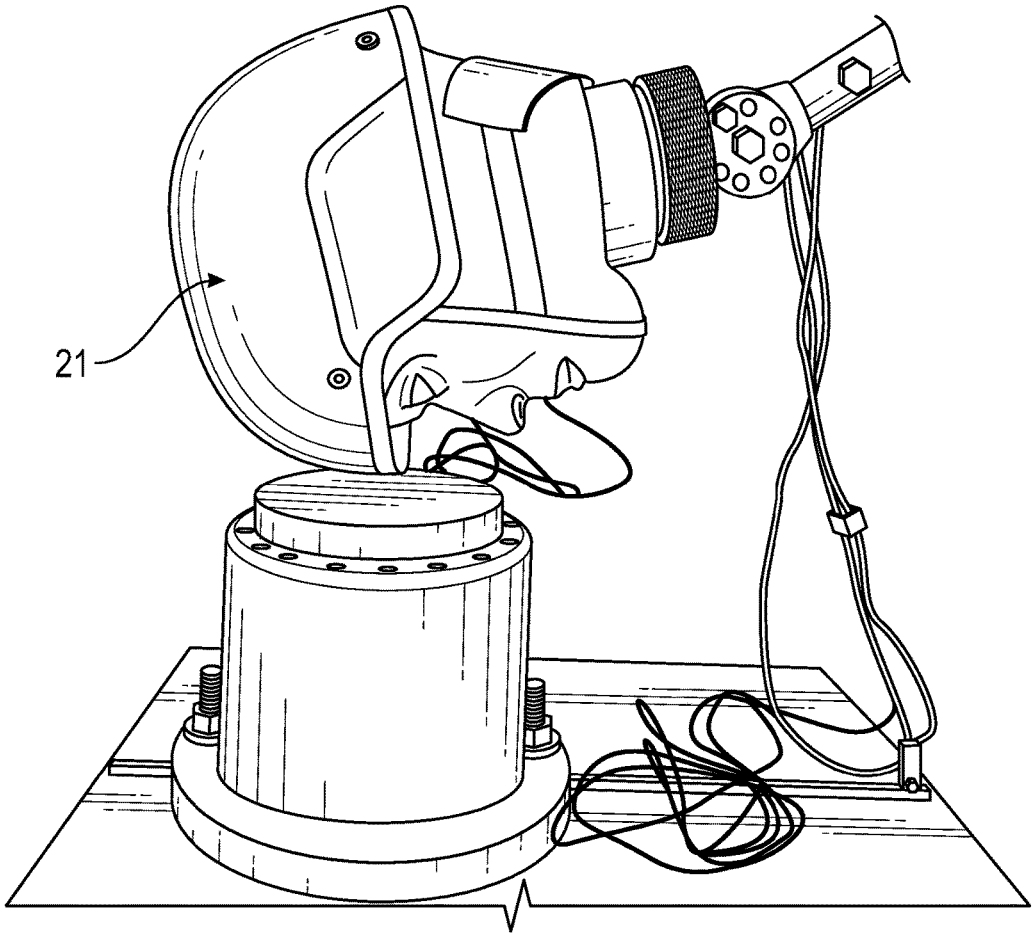
FIG. 9 is a photograph of a helmeted headform with or without the helmet of the present invention.

A large size Advanced Combat Helmet (ACH) provided by Team Wendy was used. The helmet was fit on a medium size NOCSAE (National Operating Committee on Standards for Athletic Equipment) headform with and without the use of First Contact insert (see FIGS. 4, 5, and 9). The ACH fitting pads were installed in the "standard" configuration and helmet fitting on the head was conformed to the military guidance document (TM 10-8470-204-10).

The drop test was performed in accordance with the Federal Motor Vehicles Safety Standard (FMVSS) 218, for motorcycle helmets. The impact sites, impact velocities were modified for the needs of testing military helmet according to the methods described by McEntire and Whitley. In the current test series, a NOCSAE headform was used instead of a rigid DOT headform. The helmeted headform was impacted front, side, and rear locations onto a flat anvil at 10 fps and 14 fps velocity. The head acceleration in x-, y-, and z-directions was measured by three accelerometers (Endevco Model 7264-2k, Meggitt, CA) mounted at the center of the gravity of the headform. The data was collected using DEWESoft SIRIUS data acquisition system (Dewesoft, Slovenia) at sampling rate of 2,000 S/s. A First Contact product made of approximately 2 mm thick graphite material was fitted on the NOCSAE headform. At each impact velocity and location, the helmeted headform was tested first (test repeated three times) and followed by the helmeted-headform wearing the First Contact product (test repeated three times), as shown in TABLE 8.

TABLE 8

Helmet drop test matrix

| Helmet Impact Location | Impact Velocity (fps) | Impact Height (ft) | ACH | ACH with First Contact |
|---|---|---|---|---|
| Front | 10, 14 | 1.554, 3.106 | 3 tests at each height | 3 tests at each height |
| Side | 10, 14 | 1.554, 3.106 | 3 tests at each height | 3 tests at each height |
| Rear | 10, 14 | 1.554, 3.106 | 3 tests at each height | 3 tests at each height |

Results

The head resultant accelerations obtained from each test at 10 ft and 14 ft impact velocities are listed in TABLES 9 and 10. The percentage change of the average resultant head accelerations for each impact condition was calculated. The percentage change is defined as the relative change between the head acceleration value from with First Contact product and the head acceleration value from without First Contact product, and divided by the value from without the First Contact product. It is noticed that the second and third impacts generally produced a higher response than the initial impact for both helmet with and without First Contact. For rear impact, the reduction of head acceleration due to the use of the First Contact was 10% and 4% at 10 fps and 14 fps impact, respectively. For frontal impact, with the use of First Contact, the average resultant head acceleration increased by 5% and 2%, respectively at 10 fps and 14 fps impact. The back of the helmet had relatively larger padding area than other locations. The 10% reduction in head acceleration from 10 fps rear impact case shows that the addition of the First Contact can help distribute the force over larger padding areas and as a result, more energy was absorbed.

TABLE 9

Helmet and helmet with First Contact tested at 10 fps

| | Impact Site | Resultant Head Acceleration (g) Drop 1 | Drop 2 | Drop 3 | Mean (g) | SD (g) | ACH + insert vs. ACH (%) |
|---|---|---|---|---|---|---|---|
| ACH | Front | 78 | 84 | 89 | 84 | 5.57 | |
| ACH with insert | Front | 66 | 99 | 98 | 88 | 18.59 | 5% |
| ACH | Back | 74 | 83 | 89 | 82 | 7.50 | |
| ACH with insert | Back | 66 | 72 | 71 | 74 | 3.46 | −10% |

TABLE 10

Helmet and helmet with First Contact tested at 14 fps

| | Impact Site | Resultant Head Acceleration (g) Drop 1 | Drop 2 | Drop 3 | Mean (g) | SD g) | ACH + insert vs. ACH (%) |
|---|---|---|---|---|---|---|---|
| ACH | Front | 168 | 212 | 216 | 198 | 26.41 | |
| ACH with insert | Front | 199 | 204 | 205 | 203 | 2.96 | 2% |
| ACH | Back | 188 | 210 | 210 | 203 | 12.84 | |
| ACH with insert | Back | 178 | 198 | 207 | 194 | 14.87 | −4% |

Example 3

The objectives of the study were to evaluate the energy dissipation performance of the helmet First Impact Reducing Surface Total Contact (First Contact) design of the present invention when it was incorporated with: 1) the modern Advance Combat Helmet (ACH) currently used by the U.S. Army and 2) the ACH shell along with an array of spring (i.e. an energy absorption mechanism) as the replacement of the original pad materials in ACH. To evaluate the impact performance of these various helmet designs/configurations, a series of helmet blunt impact tests were conducted according to the test methodology reported by McEntire and Whitley (2005) at U.S. Army Aeromedical Research Laboratory. The resultant acceleration measured at the center of the gravity of the headform were analyzed and compared between the impacts with and without use of the First Contact product at 10 fps and 14.14 fps impact velocities. Results from frontal and rear impact tests using ACH only and ACH with First Contact are summarized and reported. Head acceleration results from crown and rear impact locations at two impact velocities are summarized and compared between the ACH only, the ACH with First Contact, and the ACH with spring array and First Contact.

Methods

Advance Combat Helmet and First Contact

A large size Advanced Combat Helmet (ACH) provided by Team Wendy was used. The helmet was fit on a medium size NOCSAE (National Operating Committee on Standards for Athletic Equipment) headform with and without the use of First Contact insert (see FIGS. 4, 5, and 9). The ACH fitting pads were installed in the "standard" configuration and helmet fitting on the head was conformed to the military guidance document (TM 10-8470-204-10).

In addition to the use of original ACH helmet, a First Contact product made of approximately 2 mm thick graphite material was incorporated between padding and NOCSAE headform. The First Contact was molded which fits the NOCSAE headform contour (FIG. 5).

A third test series used a modified ACH helmet provided by Dr. Hyman. This modified helmet used a number of metal springs (as an energy absorption mechanism) attached to the inner shell surface of the ACH helmet to replace the pad materials in the original ACH design. The First Contact produced was used with this modified ACH helmet as the third helmet configuration (FIG. 10).

Helmet Impact Test

All helmet drop tests were performed in accordance with Federal Motor Vehicles Safety Standard (FMVSS) 218, for motorcycle helmets. The impact sites, impact velocities were however modified for the needs of testing military helmets according to the methods described by McEntire and Whitley. In the current test series, a NOCSAE headform was used instead of a rigid DOT headform. The helmeted headform was impacted front, rear, and crown locations onto a flat anvil at 10 fps (3.05 m/s) and 14 fps (4.31 m/s) velocities. The corresponding drop heights were 1.554 ft (0.474 m) and 3.106 ft (0.947 m), respectively. The head acceleration in the x-, y-, and z-directions was measured by three accelerometers (Endevco Model 7264-2k, Meggitt, CA) mounted at the center of the gravity of the headform. The data was collected using DEWESoft SIRIUS data acquisition system (Dewesoft, Solvenia) at a sampling rate of 2,000 S/s.

Data Analysis

TABLE 11 lists the test design and matrix. Each helmet design/configuration was tested at two impact velocities and three impact locations (repeated three times). The average resultant head acceleration along with +/− one standard deviation (SD) was calculated and compared between three helmet design/configurations. In addition, the percentage change of the average resultant head acceleration between different helmet configurations was also calculated. This percentage change is defined as the relative change of the head acceleration value from with First Contact product (ACH pad and ACH spring) to that from without First Contact product and divided by the value from without First Contact product.

TABLE 11

Helmet drop test matrix

| Helmet Impact Location | Impact Velocity (fps) | Impact Height (ft) | Helmet Configuration/Design I: ACH | II: ACH with First Contact | III: ACH shell with First Contact with spring |
|---|---|---|---|---|---|
| Front, rear, crown | 10 | 1.554 | 3 tests each | 3 tests each | 3 tests each |
| Front, rear, crown | 14 | 3.106 | 3 tests each | 3 tests each | 3 tests each |

Results

10 Fps Impact Velocity

The resultant head accelerations obtained from 10 fps (3.05 m/s) impact tests for rear and crown impact sites are shown in TABLE 12. In comparison with the head acceleration measured from ACH pad helmet only (Config. I), the percentage change (reduction) of the head acceleration due to the use of the ACH pad with First Contact (Config. II) and the ACH Spring with First Contact (Config. III) was −15% and −5.8%, respectively, from rear impact location. The back of the helmet had relatively larger padding area than the other helmet locations. The 15% reduction in head acceleration from 10 fps rear impact shows that the addition of the First Contact can help distribute the force over larger padding area and as a result, more energy was absorbed.

Figure 11:
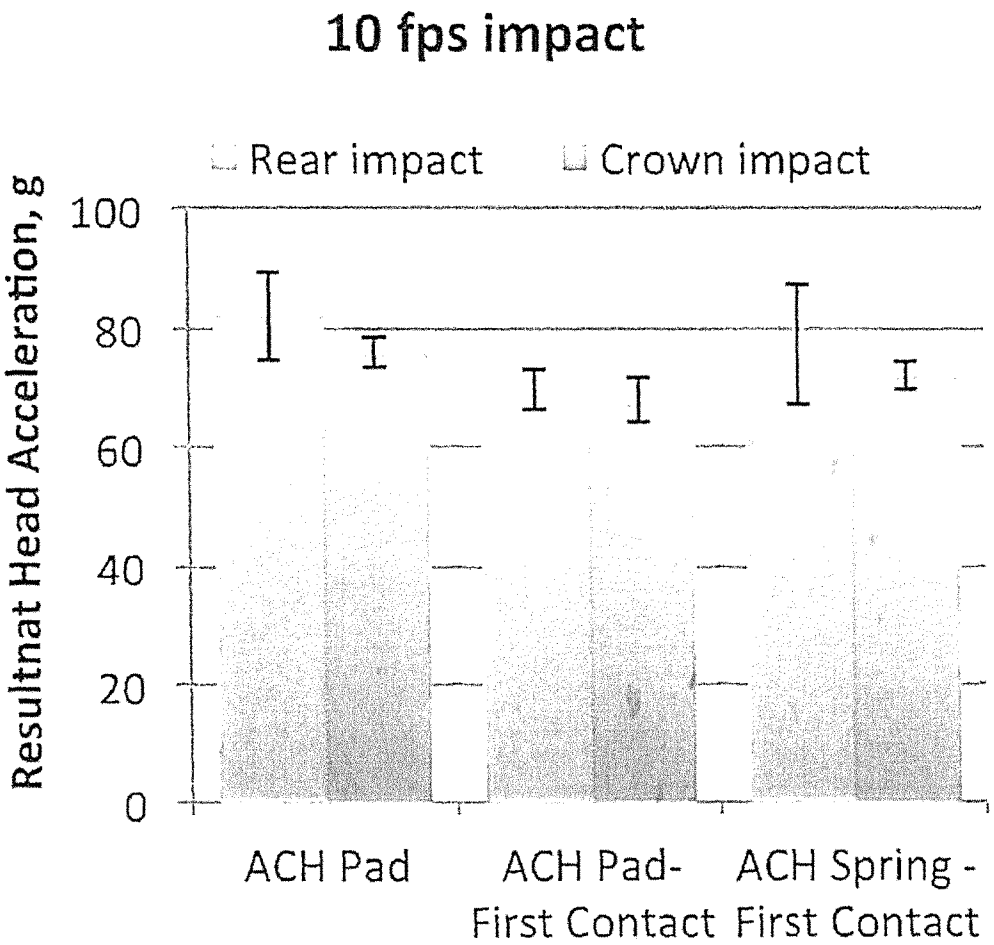
FIG. 11 is a graph of the comparison of the peak average head acceleration along with a +/− one standard deviation between three helmet configurations resulting from 10 fps impact at two impact locations.

For crown impact, compared to the ACH pad only, the corresponding percentage change in head acceleration was −11% and −5.3% due to the use of the First Contact (Config. II) and the ACH spring with First Contact (Config. III), respectively. Overall, the use of springs as the replacement of padding materials in ACH reduced head acceleration by approximately 5% from both rear and crown impact locations at 10 fps. It was also noted that for the crown impact of ACH with Spring and First Contact (*), the test as done with four missing springs (TABLE 12). FIG. 11 shows the plots of the peak average head acceleration along with one standard deviation from two impact locations.

TABLE 12

ACH with original pad, with First Contact, and with spring and First Contact tested at 10 fps (3.05 m/s)

| 10 fps Impact | Impact site | Peak Resultant Head Acceleration (g) Drop 1 | Drop 2 | Drop 3 | Mean (g) | SD (g) | Compared to ACH Pad only (%) |
|---|---|---|---|---|---|---|---|
| ACH pad | Rear | 74 | 83 | 89 | 82 | 7.50 | |
| ACH with First Contact | | 66 | 72 | 71 | 70 | 3.46 | −15% |
| ACH Spring with First Contact | | 71 | 72 | 89 | 77 | 10.12 | −5.8% |
| ACH pad | Crown* | 77 | 78 | 73 | 76 | 2.65 | |
| ACH with First Contact | | 65 | 72 | 66 | 68 | 3.79 | −11.0% |
| ACH Spring with First Contact | | 70 | 71 | 75 | 72 | 2.65 | −5.3% |

14.14 Fps Impact Velocity

The resultant head accelerations obtained from 14.14 fps (4.31 m/s) impact tests for rear and crown impact sites are shown in TABLE 4. For impact to rear site of the helmet, with the use of First Contact, the average resultant head acceleration reduced by 4.2% compared to ACH only. It appeared that for rear impact, the reduction of the head acceleration at higher impact velocity was not as good as that at lower impact velocity (10 fps). Since two rear springs were separated from the shell due to failure of the adhesive during 14.14 fps tests which could affect the rear impact response, the test data from rear impact with ACH spring configuration was not analyzed.

For crown impact, compared to the head acceleration measured from ACH helmet only, the use of the First Contact reduced the peak head acceleration by 17.7%. Along with 11% reduction in head acceleration from 10 fps impact, the data shows that the application of the First Contact can help distribute the force over larger padding areas in the crown region, and as a result, more energy was absorbed.

Figure 12:
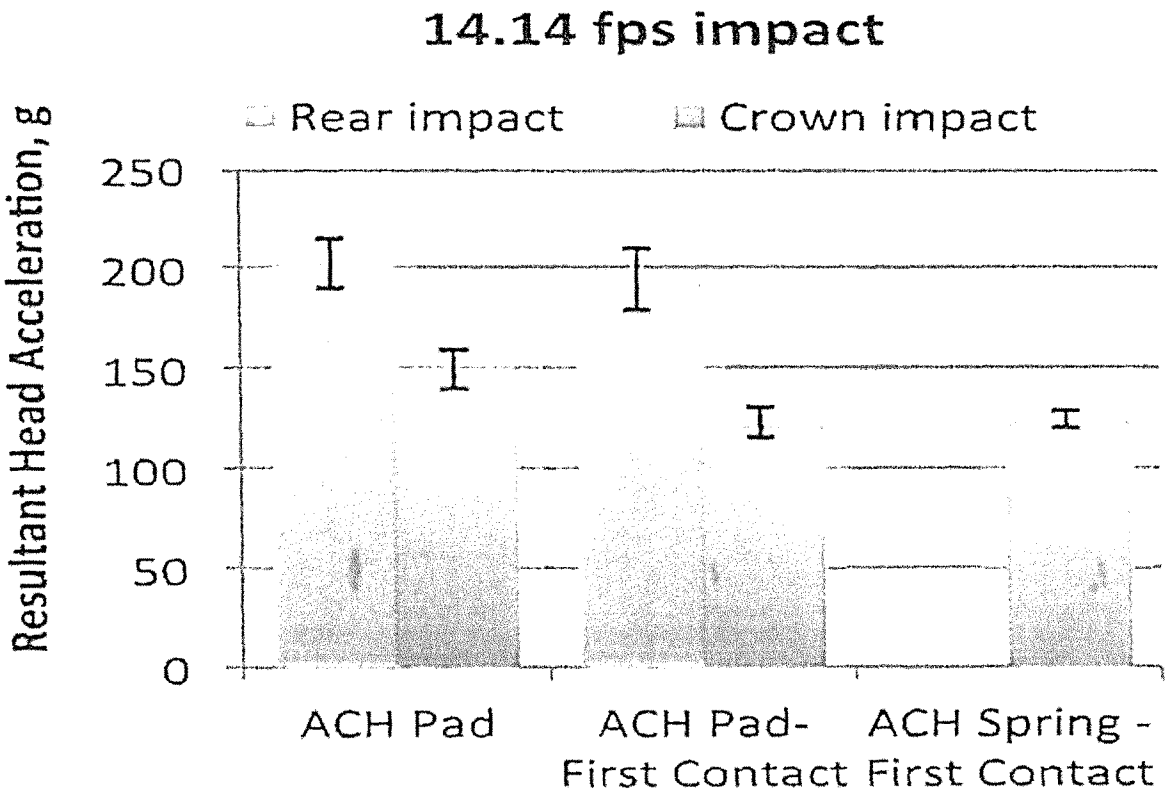
FIG. 12 is a graph of the comparison of peak average head acceleration along with a +/− one standard deviation between three helmet configurations resulting from 14.14 fps impact at two impact locations.

Again, for the crown impact results measured from the individual of the ACH shell, spring and First Contact, the test was conducted with four missing springs, two on the back and two in the front (#). The current test results showed that the use of the ACH with spring and the First Contact decreased head acceleration by 16.8% as compared to that with ACH pad only. FIG. 12 shows the plots of the peak average head acceleration along with +/− one standard deviation from two impact locations at 14.14 fps.

TABLE 13

ACH with original pad, with First Contact and with Spring and First Contact tested at 14.14 fps (4.31 m/s)

| 14.14 fps Impact | Impact site | Peak Resultant Head Acceleration (g) Drop 1 | Drop 2 | Drop 3 | Mean (g) | SD (g) | Compared to ACH Pad only (%) |
|---|---|---|---|---|---|---|---|
| ACH pad | Rear | 188 | 210 | 210 | 203 | 12.84 | |
| ACH with First Contact | | 178 | 198 | 207 | 194 | 14.87 | −4.2% |
| ACH pad | Crown# | 138 | 158 | 152 | 149 | 9.99 | |
| ACH with First Contact | | 115 | 123 | 130 | 123 | 7.51 | −17.7% |
| ACH Spring with First Contact | | 126 | 127 | 119 | 124 | 4.36 | −16.8% |

FE Modeling of Drop Test

A detailed, validated computer model of human head based on finite element (FE) technique (Zhang, et al., 2001) was applied to simulate helmet drop tests conducted on three different helmet configurations. The differences in brain responses predicted by the model between the head with and without use of First Contact product as well as with Spring were compared and results were assessed for concussion risk at a given impact condition.

Method

The measured head acceleration data from helmet drop tests were applied to the head model to compute the brain pressure within the brain. Five cases were simulated (TABLE 14).

TABLE 14

Helmet drop case simulated using FE head model

| 10 fps Impact | Impact Location |
|---|---|
| ACH pad | Rear |
| ACH with First Contact | |
| ACH Spring with First Contact | |
| ACH pad | Crown |
| ACH with First Contact | |

Results

Figure 13B:
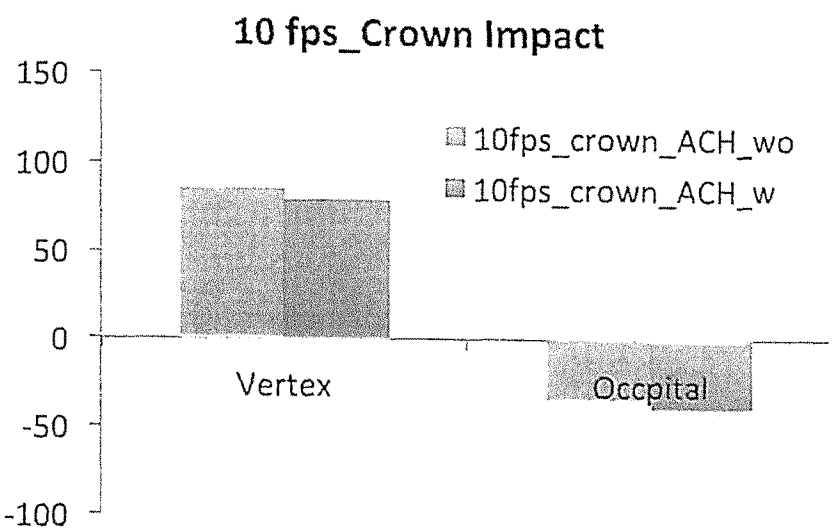
FIGS. 13A and 13B are graphs of the comparison of the peak brain pressure responses between three helmet configurations resulting from 10 fps impact at rear (FIG. 13A) and crown (FIG. 13B) helmet locations.
Figure 13A:
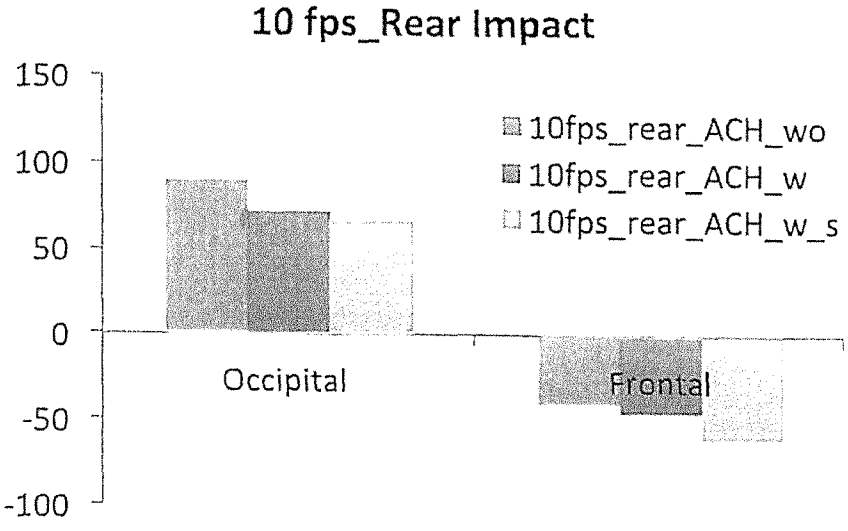

FIGS. 13A and 13B and TABLE 15 show the peak values of intracranial pressure at the coup site predicted for the head model for rear and crown impact tests. With the use of First Contact, the model predicted brain pressure at the impact site (coup pressure) was reduced by 20% and 6%, respectively, for rear and crown impact as compared to the results from ACH only impact. Note that the percentage reduction in head acceleration for the above two locations was 15% and 11%, respectively, due to the use of the First Contact. However, the negative pressure at the contrecoup site was slightly increased in the case of using First Contact (10% in rear impact and 7% in crown impact). The use of ACH spring with First Contact reduced coup brain pressure by 26% in rear impact as compared to the result from ACH helmet only. However, ACH spring with First Contact resulted in increases in contrecoup pressure by as high as 50%. NOTE: springs were used as an example only to demonstrate the ability to absorb additional energy between the hard inner and outer shell and that this is synergistic or additive to protection from dispersion of energy by the total contact helmet—see results. Springs recoil and would not be chosen for the method of energy dissipation in the helmet, thus, the reported increase in coup-contra-coup is "man made" and not seen in other testing with total contact insert.

As far a concussion injury risk assessed by brain pressure response, the logistic model of concussion was used which was developed using the previous FE modeling studies of NFL™ concussion cases (58 cases). For 10 fps impact speed, the brain pressure prediction from the current studies suggested that the concussion injury risk probability reduced from 44% to 31% due to the use of ACH with First Contact and down to 28% due to the use of spring with First Contact.

TABLE 15

FE head model predicted brain pressure responses and associated injury probability for concussion

| 10 fps Impact | Impact Location | Coup Pressure (kPa) | Injury Probability |
|---|---|---|---|
| ACH pad | Rear | 89 | 44% |
| ACH with First Contact | | 72 | 31% |
| ACH Spring with First Contact | | 66 | 28% |
| ACH pad | Crown | 85 | 42% |
| ACH with First Contact | | 80 | 38% |

Throughout this application, various publications, including United States patents, are referenced by author and year and patents by number. Full citations for the publications are listed below. The disclosures of these publications and patents in their entireties are hereby incorporated by reference into this application in order to more fully describe the state of the art to which this invention pertains.

The invention has been described in an illustrative manner, and it is to be understood that the terminology, which has been used is intended to be in the nature of words of description rather than of limitation.

Obviously, many modifications and variations of the present invention are possible in light of the above teachings. It is, therefore, to be understood that within the scope of the appended claims, the invention can be practiced otherwise than as specifically described.

What is claimed is:

1. A method of protecting a head of an individual, the method consisting of the steps of:

the individual wearing a total contact helmet including a rigid body having an inner surface, wherein 100% of the inner surface is in direct contact with a surface of the individual's head and is made from non-compressible hard plastic, and having a force distribution mechanism that distributes a force of an impact laterally to a large surface area of the rigid body; and when receiving an outside impacting force to the total contact helmet, distributing the force of impact over the surface area of the total contact helmet.

2. A method of decreasing risk of concussion and head injury in an individual, the method consisting of the steps of:

the individual wearing a total contact helmet including a rigid body having an inner surface, wherein 100% of the inner surface is in direct contact with a surface of the individual's head when worn, the rigid body made from non-compressible hard plastic, and having a force distribution mechanism for distributing the force of an impact laterally to a large surface area of the rigid body;

when receiving an outside impacting force to the total contact helmet, distributing the force of impact over the surface area of the total contact helmet; and decreasing the risk of concussion and head injury of the individual.

3. A method of protecting a head of an individual, the method consisting of the steps of:

the individual wearing a total contact helmet including a rigid body having an inner surface, wherein 100% of the inner surface is in direct contact with a surface of the individual's head and is made from carbon fibers, and having a force distribution mechanism that distributes a force of an impact laterally to a large surface area of the rigid body; and when receiving an outside impacting force to the total contact helmet, distributing the force of impact over the surface area of the total contact helmet.

4. A method of decreasing risk of concussion and head injury in an individual, the method consisting of the steps of:

the individual wearing a total contact helmet including a rigid body having an inner surface, wherein 100% of the inner surface is in direct contact with a surface of the individual's head when worn, the rigid body made from carbon fibers, and having a force distribution mechanism for distributing the force of an impact laterally to a large surface area of the rigid body;

when receiving an outside impacting force to the total contact helmet, distributing the force of impact over the surface area of the total contact helmet; and decreasing the risk of concussion and head injury of the individual.

* * * * *